US009476255B2

(12) United States Patent
Nurre et al.

(10) Patent No.: US 9,476,255 B2
(45) Date of Patent: Oct. 25, 2016

(54) WINDOW SHADE SYSTEM AND HOUSING-GUIDE ASSEMBLY

(71) Applicant: PARATA SOLUTIONS LLC, Barrington, IL (US)

(72) Inventors: Christopher J. Nurre, Barrington, IL (US); William B. Nurre, Barrington, IL (US)

(73) Assignee: PARATA SOLUTIONS LLC, Barrington, IL (US)

( * ) Notice: Subject to any disclaimer, the term of this patent is extended or adjusted under 35 U.S.C. 154(b) by 0 days.

(21) Appl. No.: 14/628,890

(22) Filed: Feb. 23, 2015

(65) Prior Publication Data

US 2016/0090779 A1 Mar. 31, 2016

Related U.S. Application Data

(60) Provisional application No. 62/056,985, filed on Sep. 29, 2014.

(51) Int. Cl.
*E04F 10/06* (2006.01)
*E06B 9/42* (2006.01)

(52) U.S. Cl.
CPC ..... *E06B 9/42* (2013.01)

(58) Field of Classification Search
CPC ..... E06B 9/42
USPC ..... 160/23.1, 26, 30, 319, 321, 323.1–326
See application file for complete search history.

(56) References Cited

U.S. PATENT DOCUMENTS 1,102,094 A 6/1914 Smith
2,316,027 A 4/1943 Swormstedt
3,379,237 A 4/1968 Worthington
4,006,770 A 2/1977 Ferguson
4,220,189 A * 9/1980 Marquez ..... E06B 9/17076 160/23.1
4,357,978 A 11/1982 Keller et al.
4,399,855 A 8/1983 Volfson
4,419,982 A * 12/1983 Eckels ..... E06B 9/40 126/625
4,458,739 A * 7/1984 Murray ..... E06B 9/582 160/23.1
4,865,109 A 9/1989 Sherman
5,078,194 A 1/1992 Phillips
5,296,964 A * 3/1994 Shopp ..... G03B 21/58 160/19
5,829,507 A 11/1998 Pawlowski
5,850,864 A * 12/1998 Decker ..... E06B 9/42 160/268.1
6,111,694 A * 8/2000 Shopp ..... G03B 21/58 160/23.1
6,230,782 B1 * 5/2001 Reichert ..... E06B 9/17023 160/23.1

(Continued)

*Primary Examiner* — Katherine Mitchell
*Assistant Examiner* — Jeremy Ramsey
(74) *Attorney, Agent, or Firm* — Barnes & Thornburg LLP

(57) ABSTRACT

A window shade system and housing-guide assembly for shading a window systemically includes a shade assembly, a bracket element and a guide-cover element. The shade element is furlable and unfurlable about an axis for rotation for selectively shading an outfitted window site. The bracket element includes a bracket-to-support interface portion and a guide-cover attachment portion. The guide-cover element includes a bracket-attachment portion, a shade-cover portion, and a shade-guide portion. The guide-cover element is attachable to the bracket element via mated engagement of the guide-cover attachment portion and the bracket-attachment portion. The shade-cover portion is formed so as to subtend an arc length radially anterior relative to the interface portion. The furled shade element is receivable in a space defined by the shade-cover portion and unfurlable via a shade-letting gap defined intermediate the shade-guide portion and the interface portion.

20 Claims, 40 Drawing Sheets

(56) References Cited

U.S. PATENT DOCUMENTS 6,422,286 B1 * 7/2002 Osterberg ..... G09F 11/025 160/23.1
6,508,291 B2 * 1/2003 Schniggendiller .. E04F 10/0685 135/88.11
6,823,925 B2 11/2004 Militello et al.
7,089,992 B2 8/2006 Walter et al.
7,493,933 B2 2/2009 Li
8,070,660 B2 * 12/2011 Seidel ..... E06B 9/40 160/23.1
8,261,808 B2 * 9/2012 Perkowitz ..... A47H 2/00 160/108
8,726,969 B2 5/2014 Lin
8,746,320 B2 6/2014 Yu et al.
8,763,675 B2 7/2014 Zhu
8,830,058 B2 9/2014 Yeh
2004/0099384 A1 * 5/2004 Wu ..... B44D 3/18 160/321
2006/0060313 A1 * 3/2006 Lukos ..... E04F 10/0662 160/242
2008/0041540 A1 2/2008 Li
2008/0264582 A1 * 10/2008 Coenraets ..... E06B 9/40 160/319
2009/0212148 A1 8/2009 Lebert
2011/0061822 A1 * 3/2011 Tremaine, III ..... E06B 9/0692 160/311
2013/0032300 A1 2/2013 Yu et al.
2013/0292961 A1 11/2013 Katada
2014/0138981 A1 5/2014 Lin
2014/0250804 A1 * 9/2014 Kuperus ..... E06B 9/40 52/173.1
2014/0262081 A1 9/2014 Seib

* cited by examiner

WINDOW SHADE SYSTEM AND HOUSING-GUIDE ASSEMBLY

PRIOR HISTORY

This patent application claims the benefit of or priority to U.S. Provisional Patent Application No. 62/056,985 filed in the United States Patent and Trademark Office on 29 Sep. 2014.

BACKGROUND OF THE INVENTION

1. Field of the Invention

The present invention generally relates to the field of window treatments, and more particularly to a window shading system and housing-guide assembly for enhancing the delivery and housing of a window shade element.

2. Brief Description of the Prior Art

The field of window shading systems and the like is somewhat well-developed. The art relating to window shading means comprising unique housing assembly and unfurled shade delivery means is a bit more limited. Some of the more pertinent prior art directed to these types of developments is believed to be briefly described hereinafter. U.S. Pat. No. 1,102,094 ('094 patent), which issued to Smith, for example, discloses a Window Screen. The '094 patent describes a combination window casing and window screen assembly.

A substantially semi-tubular housing is secured to the outer face of the casing, and caps closed at one end and open at the other are further disclosed. The ends of said housing extend into the open ends of said housing and extend into the open ends of said caps. The caps are secured to the window casing for holding the housing in place. The lower edge of the housing occurs in spaced relation to the window casing, and a roller is pivotally supported within the housing. A screen is on the roller, and guides receive the edges of said screen. A hand hold on the lower edge of said screen extends between the guide strips, and means carried by said hand hold frictionally engage said casing to hold the screen in adjusted position longitudinally of the guide strips.

U.S. Pat. No. 2,316,027 ('027 patent), which issued to Swormstedt, discloses a Dark Closure. The '027 patent describes a housing for a spring roller, substantially semi-circular end wall members each having an attachment foot, said end wall members shaped to provide respectively pivotal and non-pivotal support for a spring roller, and a pair of telescopic sections forming lateral wall portions of said housing, said sections having sockets on their ends, and said end wall members having pins to enter said sockets whereby the said lateral wall portions of said housing, said sections having sockets on their ends, and said end wall members having pins to enter said sockets whereby the said lateral wall portions of said housing may be removed without disturbing the said end wall members.

U.S. Pat. No. 4,220,189 ('189 patent), which issued to Marquez, discloses a Window Shade Sealing System. The '189 patent describes a complete window shade and sealing system having a separate unit having peel-off adhesive permitting all portions of the system to be press-fitted onto an existing window frame, creating a completely sealed cover for the window when the shade is in its down position, preventing the entry of air, dust, radio-active fall-out, etc., and greatly reducing energy-sapping heat transfers occurring through the window by creating an air pocket.

U.S. Pat. No. 4,357,978 ('978 patent), which issued to Keller et al., discloses a Roller Shade Seal System. The '978 patent describes a simple, relatively low cost system for sealing an ordinary roller shade with respect to the window frame sides, top and bottom is provided. The roller shade seal system essentially comprises a pair of edge seal assemblies in the form of elongate mounting strip members adapted to be permanently mounted to opposite vertical faces of the window frame trim, and a pair of sealing strip members in the form of elongate, generally U-shaped channels adapted to sealably engage the latter edges of the shade, releasably mounted to an associated mounting strip. The window shade sealing system is completed by a shade bottom edge seal comprising a rigid bottom strip reinforcing member, a sill sealing strip and a shade top sealing member.

U.S. Pat. No. 4,399,855 ('855 patent), which issued to Volfson, describes a Roll Type Closure Assembly for a Window. The '855 patent discloses a roll type closure assembly for a window opening utilizing a roller shade mounted by brackets in the window opening. Side edge guides are provided which include a channel portion for receiving the side edges of the window shade, a mounting flange portion and a connecting portion between the mounting flange portion and the channel portion.

A flex line is provided in the connecting portion to allow the mounting flange portion and the channel portion to be moved relative to each other between a first position extending generally perpendicular to a plane bisecting the channel portion for mounting on the window casing inside the window opening and a second position extending generally parallel to a plane bisecting the channel portion for mounting on the window casing outside the window opening. A U-shaped roller housing is provided for enclosing the roller and is mounted by end caps on the roller mounting brackets to provide a seal between the upper portion of the window shade and the top of the window casing.

U.S. Pat. No. 8,726,969 ('969 patent), which issued Lin, describes a Multi-Function Shade Assembly and Method. The '969 patent discloses a double shade including a head rail, at least one end cap having an end panel disposed with the head rail and a bracket arm extending from the end panel, a first window treatment being disposed with the head rail, a second window treatment being disposed with the bracket arm, and a clip engaged with the first window treatment and the second window treatment.

A double shade includes a head rail extending between first and second ends, first and second end caps including respective end panels mounted with the first and second ends of the head rail and respective bracket arms extending from the end panels, a cellular shade mounted with the head rail, and a roller shade extending between first and second ends respectively mounted with the bracket arms of the first and second end caps, wherein the cellular shade is independently movable relative to the roller shade.

U.S. Pat. No. 8,830,058 ('058 patent), which issued to Yeh, describes a Duet Power-Driven Window Shade. The '058 patent discloses a duet power-driven window shade comprising a controlling device to receive an external controlling signal, which is then analyzed, determined and compared with a preset value in a memory unit of the controlling device. A driving signal is output via a processing unit according to a comparing result. A power source then brings convolutions of a first covering sheet and a second covering sheet in sequence or concurrently for increasing the rolling speed and the using convenience and allowing the connecting members connected to the covering sheets to be efficiently rolled up without entanglement so that the duet power-driven window shade is smoothly operated.

From a consideration of the foregoing, it will be noted that the prior art perceives a need for a window shade system and housing-guide assembly for shading a window systemically including a shade assembly, a bracket element and a guide-cover element according to the teachings of the following specifications. The prior art particularly appears to perceive a need for housing-guide assembly for housing and guiding shade element such that the bracket element includes a bracket-to-support interface portion and a guide-cover attachment portion, and the guide-cover element includes a bracket-attachment portion, a shade-cover portion, and a shade-guide portion as summarized in more detail hereinafter.

SUMMARY OF THE INVENTION

The window shade furling system or assembly according to the present invention was designed, in part, to create a shade assembly that would enable the user to better control heat transfer to and from a building via its structural envelope. State of the art shading solutions typically provide a shade cloth or element that hangs from a glazing unit and functions primarily to block direct sunlight, with little to no containment of the heat or "oven effect" that is created intermediate the outward facing face of the shade cloth or element and the inside face of the glass and/or glazing system.

A primary objective of the shade furling assembly or system according to the present invention is thus to control and/or contain the "oven effect" or heat transfers at the glass or glazing system site(s) by placing or directing a pre-engineered shade cloth or element against the face of the header and adjacent vertical glazing system mullions. This arrangement creates an insulated space or layer between the window glass and the outward or outer face of the shade cloth or element. The mounted location of the shade furling system or assembly further functions to control or guide convective heat movements into the plenum of the interior space of the outfitted building.

Another primary objective of the shade furling system or assembly according to the present invention is to provide an assembly with negligible shade tube deflection whereby the shade cloth or element unwinds from the housing "tube" such that the shade cloth or element will unfurl in a manner that forces the shade fabric or element to be guided off of a horizontal flange or lip as at thereby rendering or effecting a horizontally level shade element as it becomes fully unfurled. Without this guide mechanism, state of the art shade cloths or elements typically tend to ripple due to state of the art shade housing tube deflection or bending inherent to downwardly directed load along the tube length.

The shade furling assembly also provides a unique feature that is currently not available in the marketplace. The shade furling assembly according to the present invention has been developed with a view toward providing an adhesive mount or layer to avoid mechanically fastening the shade bracket element to the building construction or system. Mechanically fastened shade assemblies often operate to void the warranty and/or otherwise negatively affect design performance, pressure gradient and moisture controls.

By developing an adhesively attachable shade furling assembly according to the present invention, the present invention provides a temporary (i.e. not permanent) adhesive add-on or addition to the building. Accordingly, it will be understood that an object of the present invention is thus to recognize the invention as a furniture type article of manufacture and not a base building capital cost item.

Ease of installation is another factor that played into the development of the invention. By providing an adhesively mountable installation, the present invention can be installed with a trained installation technician and not a carpenter. It is contemplated that a custom jig may be separately developed or engineered to aid installation technicians apply the preferred "twin stick" or double-sided adhesive material or layer to the anodized mounting bracket element or bracket-to-support interface portion.

To achieve these and other objectives, the preferred and alternative embodiments of the present invention primarily concern a shade furling assembly or window shade system for particularly shading a window, the housing-guide assembly of that system, and certain methodology attendant to or supported by the system and/or assembly according to the present invention. Viewed systemically, the present invention is believed to provide a window shade system embracing the basic housing-guide assembly and a window shade assembly cooperable therewith in combination with other attendant features that together operate to selectively shade a state of the art window site. A preferred and several alternative exemplary embodiments of the basic housing-guide assembly are illustrated in the drawings appended to these specifications.

The window shade system according to the present invention is believed to essentially and preferably comprise a shade assembly, a bracket element, and a guide-cover element. The shade assembly according to the present invention is believed to essentially comprise a shade element and certain axis-fixing means for fixing a shade axis of rotation. The shade element is furlable and unfurlable about the shade axis of rotation for selectively shading the window in a shade plane parallel to the window plane.

The shade element preferably comprises a shade element width, and a shade element length sufficient to selectively extend in interior parallel adjacency to the inner glazing surface of the glazing material. The shade element width is preferably less than or substantially equal to the window width for effecting or enhancing an insulative layer intermediate the shade element and the window material.

The bracket element is preferably formed from a clearly anodized aluminum material and extruded in a first dimension for forming a select bracket length in the first bracket dimension as determined by the application. The bracket element preferably comprises a bracket-to-support interface portion and a guide-cover attachment portion. The bracket-to-support interface portion is preferably planar and has an interface width extending in a second dimension. The interface portion comprises posterior bracket surfacing and anterior bracket surfacing.

The guide-cover attachment portion preferably comprises an F-shaped tongue portion, and a spacer portion. The F-shaped tongue portion comprises an inverted L-shaped portion having a primary riser portion extending in the second bracket dimension and a primary upper support portion extending in a third dimension. The primary riser portion is thus preferably orthogonal to the spacer portion, and the primary upper support portion is preferable parallel to the spacer portion. The spacer portion preferably extends in the third dimension for spacing and interconnecting the guide-cover attachment portion to the interface portion.

The guide-cover element is preferably formed from a clearly anodized aluminum material and is extruded in a first dimension for forming a guide-cover length in the first cover dimension. The guide-cover element preferably comprises an inverted Π-shaped, channel portion, a shade-cover portion, and a shade-guide portion. The channel portion preferably comprises a posterior extension portion, an anterior extension portion and a spacer extension portion.

The posterior and anterior extension portions are preferably parallel to one another extending in a second dimension and interconnected via the spacer extension portion. The spacer extension portion is preferably orthogonal to the posterior and anterior extension portions extending in the third dimension. The shade-cover portion is preferably extruded in an arc length extending in the second and third cover dimensions radially anterior relative to the posterior extension portion. The shade-guide portion is preferably planar and extruded so as to extend obliquely in the second and third cover dimensions sloped downwardly relative to the spacer extension portion.

The F-shaped tongue portion further preferably comprises a secondary lower support or flange portion, which secondary lower support portion is preferably parallel to the primary upper support portion. The upper and lower support portions simultaneously contact or engage the anterior extension portion for preventing momentary rotation of the guide-cover element relative to the bracket element at the junction site therebetween. The upper and lower support portions are preferably spaced via the riser portion so as to form a fastener-receiving channel. The fastener-receiving channel functions to receive fasteners via the anterior extension portion for selectively fastening the guide-cover element to the bracket element at periodically spaced locations along or the first dimension. The interface portion is preferably adhesively attachable to a vertical support structure such as a curtain wall or vertical portion of a superior transom or header element.

The furled portion of the shade element is received in the space defined radially inwardly by the shade-cover portion. The axis fixing means basically function to fix the shade axis of rotation radially central relative to the shade-cover portion. The guide-cover element with element-mounted shade assembly are together attachable to the support-mounted bracket element such that the F-shaped tongue portion is received in the channel portion akin to a tongue and groove assembly.

The shade-guide portion is preferably sloped downwardly relative to the spacer extension portion for slope-guiding the unfurled portion of the shade element when unfurling. The shade-guide portion terminates posteriorly at a guide-cover terminus or lip situated in inferior adjacency to the interface portion when in an assembled state. The guide-cover terminus and planar region of the shade-guide portion may be preferably outfitted with certain friction reduction means for reducing friction between the unfurling shade element and the shade-guide portion and ensuring or enhancing uniform shade element unfurlment.

The shade furling or window shade system according to the present invention may further preferably comprise certain select means for furling and unfurling the shade element of the shade assembly, which select means essentially differentiates the preferred (and second and third alternative) embodiment(s) from the first alternative embodiment. In this regard, it is contemplated that said select means may be preferably selected from the group consisting of user-powered or manually operable means and electrically-powered means for furling and unfurling the shade element of the shade assembly.

The shade furling system or window shade system according to the present invention may further preferably comprise a valance element or valance construction. The valance element or construction is cooperable with the guide-cover element for concealing or covering the same.

Other features and objects of the present invention will become more evident from a consideration of the following brief descriptions of patent drawings submitted in support of these specifications.

BRIEF DESCRIPTION OF DRAWINGS

FIG. 22(A) is a reduced first end elevational view of an assembled preferred window shade system or assembly according to the present invention with the first end components being shown in phantom.

DETAILED DESCRIPTION OF PREFERRED EMBODIMENTS

As indicated above, the window shade furling system or assembly according to the present invention was designed, in part, to create a shade assembly that would enable the user to better control heat transfer to and from a building via its structural envelope. State of the art shading solutions typically provide a shade cloth or element that hangs from a glazing unit and functions primarily to block direct sunlight, with little to no containment of the heat or "oven effect" that is created intermediate the outward facing face of the shade cloth or element and the inside face of the glass and/or glazing system.

A primary objective of the shade furling assembly or system according to the present invention is thus to control and/or contain the "oven effect" or heat transfers at the glass or glazing system site(s) by placing or directing a pre-engineered shade cloth or element against the face of the header and adjacent vertical glazing system mullions. This arrangement creates an insulated space or layer as at 109 between the window glass or glazing plane as at 100 and the outer shade element surface 92 of the shade element 20. The mounted location of the shade furling system or assembly further functions to control or guide convective heat movements into the plenum of the interior space of the outfitted building.

Figure 41B:
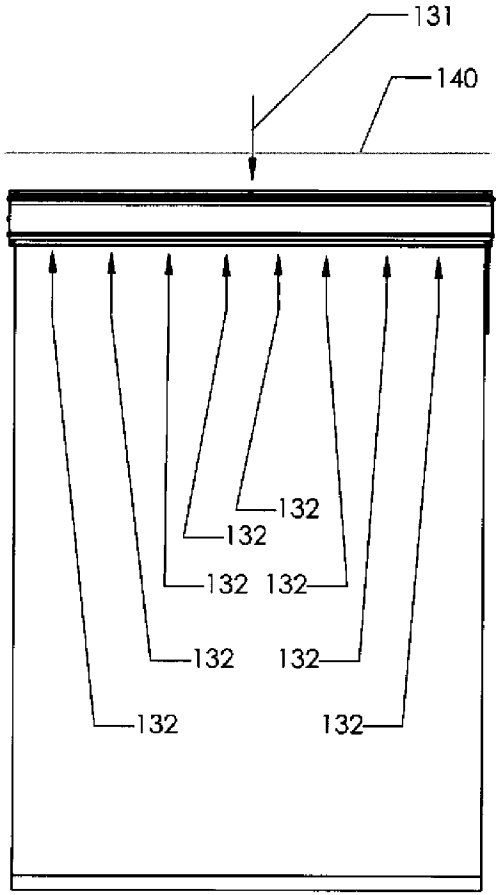
FIG. 41(B) is an anterior plan view of a shade assembly according to the present invention comprising a guide-supported shade roll for eliminating the rippling effect otherwise depicted in FIG. 41(A).
Figure 41:
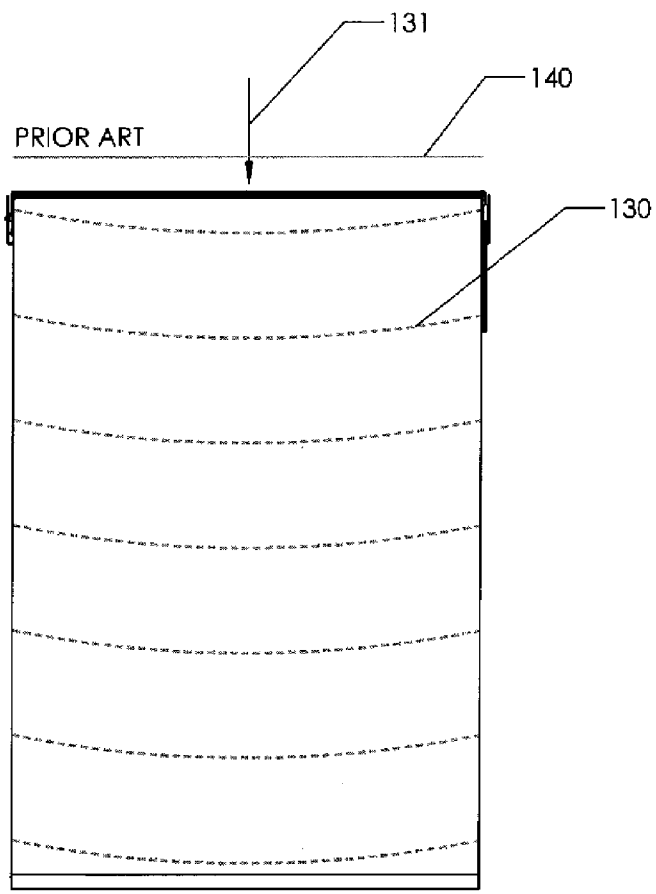
FIG. 41(A) is an anterior plan view of a PRIOR ART shade assembly comprising non-supported shade roll that tends to cause a rippling effect intermediate its length when unfurled from the shade assembly.

As stated, another primary objective of the shade furling system or assembly according to the present invention is to provide an assembly with negligible shade tube deflection whereby the shade cloth or element unwinds from the housing "tube" such that the shade cloth or element 20 will unfurl in a manner that forces the shade fabric or element 20 to be guided off of a horizontal flange or lip as at 41 thereby rendering or effecting a horizontally level shade element 20 as it becomes fully un-furled as generally depicted in FIG. 41(B).

Without this guide mechanism, state of the art shade cloths or elements typically tend to ripple due to state of the art shade housing tube deflection or bending as at arrow 130 inherent to downwardly directed load 131 along the dimensional tube length 140 as generally depicted in FIG. 41(A). Comparing FIG. 41(A) to FIG. 41(B), it will be noted that the shade assembly according to the present invention provides a continuous guide-support as at 132 along the dimensional tube length 140 of the shade assembly, which continuous guide-support 132 operates to balance the downwardly directed load 131.

The shade furling assembly also provides a unique feature that is currently not available in the marketplace. The shade furling assembly according to the present invention has been developed with a view toward providing an adhesive mount or layer as at 38 to avoid mechanically fastening the shade bracket element 18 to the building construction or system. Mechanically fastened shade assemblies often operate to void the warranty and/or otherwise negatively affect design performance, pressure gradient and moisture controls.

By developing an adhesively attachable shade furling assembly according to the present invention, the present invention provides a temporary (i.e. not permanent) adhesive add-on or addition to the building. Accordingly, it will be understood that an object of the present invention is thus to recognize the invention as a furniture type article of manufacture and not a base building capital cost item.

Ease of installation is another factor that played into the development of the invention. By providing an adhesively mountable installation, the present invention can be installed with a trained installation technician and not a carpenter. It is contemplated that a custom jig may be separately developed or engineered to aid installation technicians apply the preferred "twin stick" or double-sided adhesive material or layer 38 to the anodized mounting bracket element 18 or bracket-to-support interface portion 23.

Referring now to the drawings with more specificity, the preferred embodiments of the present invention primarily concern a shade furling assembly or window shade system for particularly shading a window 10, the housing-guide assembly of that system, and certain methodology attendant to or supported by the system and/or assembly according to the present invention. Viewed systemically, the present invention is believed to provide a window shade system embracing the basic housing-guide assembly and a window shade assembly cooperable therewith in combination with other attendant features that together operate to selectively shade a state of the art window site.

A preferred and several alternative exemplary embodiments of the basic housing-guide assembly are illustrated in the drawings appended to these specifications. The preferred housing-guide assembly or curtain wall mount version of the present invention is generally illustrated in FIGS. 1-6. A first alternative housing-guide assembly curtain wall mount version with electric option is generally illustrated FIGS. 7-8.

A second alternative housing-guide assembly or ceiling mount version of the present invention is generally illustrated in FIGS. 9-14; and a third alternative housing-guide assembly or mullion mount version of the present invention is generally illustrated in FIGS. 15-20. The preferred, second and third alternative embodiments of the housing-guide assembly show or depict hand-operable versions of the present invention. The first alternative embodiment depicts an electric option.

A state of the art window site to which the present invention or inventive concepts may be applied, may be said to basically comprise a centralized, rectangular and planar window or glazing material as at 10, and a window or glazing frame, which frame may be said to essentially comprise laterally opposed vertically extending mullion or jamb elements as at 11, a superior transom or header element as at 12, and an inferior transom or sill element as at 13. The window or glazing material 10, being rectangular in preferred practice, comprises a horizontal window dimension or window width, a vertical window dimension or window height, an inner glazing surface as at 16, an outer glazing surface as at 17, and a window plane as at 100.

The window shade system according to the present invention is believed to essentially and preferably comprise a shade assembly, a bracket element as at 18, and a guide-cover element as at 19. The shade assembly according to the present invention is believed to essentially comprise a shade element as at 20 and certain axis-fixing means for fixing a shade axis of rotation as at 104. The shade element 20 is furlable and unfurlable about the shade axis of rotation 104 for selectively shading the window 10 in a shade plane 105 parallel to the window plane 100.

The shade element 20 preferably comprises a shade element width, and a shade element length sufficient to selectively extend in interior parallel adjacency to the inner glazing surface 16 of the glazing material 10. The shade element width is preferably less than or substantially equal to the window width for effecting or enhancing an insulative layer as at 109 intermediate the shade element 20 and the window material 10.

Figure 40:
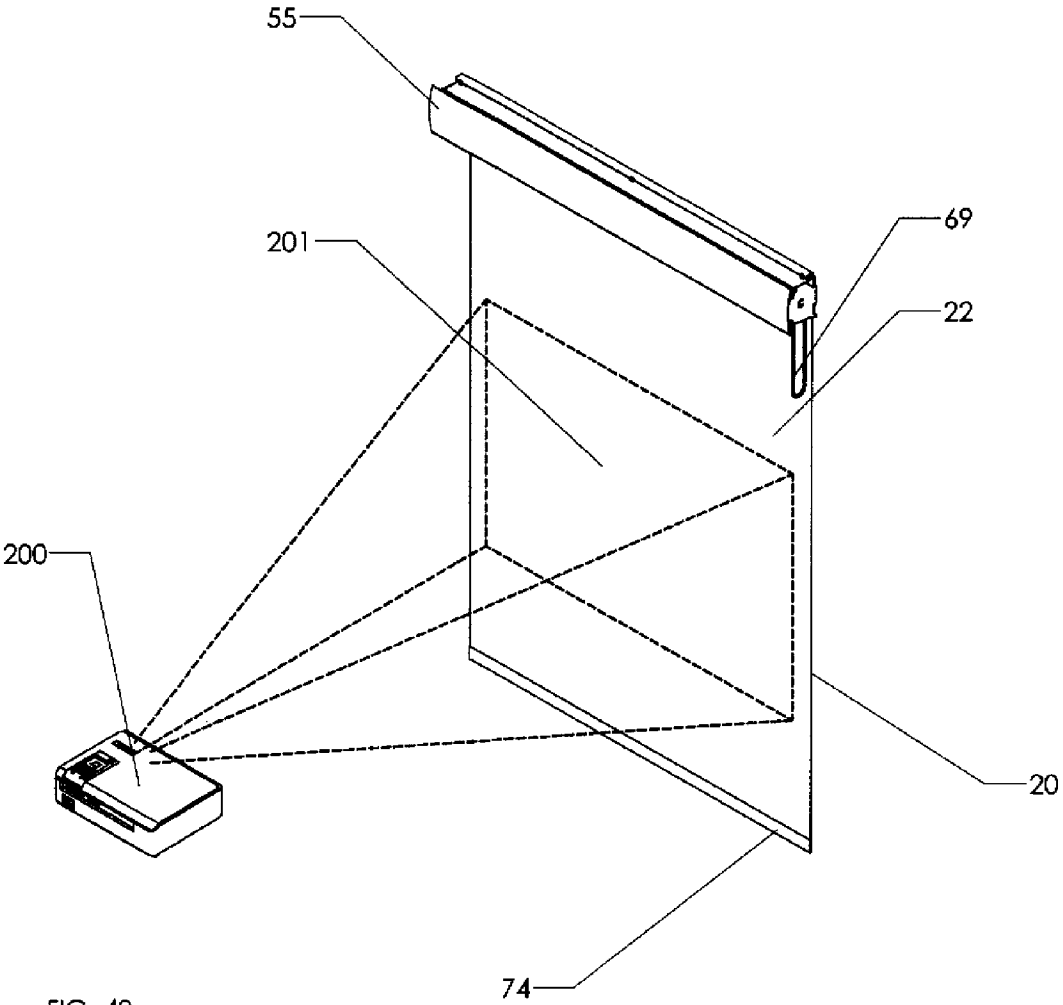
FIG. 40 is a reduced top first end perspective view of a fully assembled preferred window shade system or assembly according to the present invention with a first end cap unit assembled to the system or assembly depicting an unfurled portion of the shade element downwardly extended for providing a image projection screen according to the present invention.

The inner shade element surface 22 may be preferably formed from or comprise a dry erase material or similar other type material for enabling users to mark up the surface 22 with removable markings (not specifically illustrated), as may be beneficial to users thereof. The inner shade element surface 22 is opposite the outer shade element surface 92 of the shade element 20. Further, the surface 22 may be preferably coated with a projector screen finish allowing for projection and display of imagery as at 201 from a video projector 200 with the same quality of as a stand-alone projector screen as generally depicted in FIG. 40.

The shade element 20 is preferably outfitted with certain magnetic means or magnetic material or bottom hem bar (as at 74) for attachment at the terminal end or free end of the shade element 20. The magnetic means for attachment or magnetic material 74 at the terminal or free end of the shade element 20 may be preferably exemplified by any number of magnetic materials and thus is made magnetically attracted to a magnetic disc or anchor construction as at 75, which magnetic disc or anchor construction 75 is preferably adhesively attachable to an inferior transom or sill element 13 at the window site. Magnetic hem bar 74 is thus magnetically attached to magnetic disc or anchor construction as at 75 for sealing the shade element 20 to the base or sill element 13.

The bracket element 18 is preferably formed from a clearly anodized aluminum material and extruded in a first (bracket) dimension (as at dimension 101) for forming a select bracket length in the first bracket dimension as determined by the application. The bracket element 18 preferably comprises a bracket-to-support interface portion as at 23, a guide-cover attachment portion as at 24, and a J-shaped construction 81 extending inferiorly from the interface portion 23 for enhancing the strength of the bracket element 18 and preventing deformations in the first bracket dimension. The bracket-to-support interface portion 23 is preferably planar and has an interface width as at 25 extending in a second (bracket) dimension (as at dimension 102). The interface portion 23 comprises posterior bracket surfacing as at 26 and anterior bracket surfacing as at 27.

The guide-cover attachment portion 24 preferably comprises an F-shaped tongue portion as at 28 and a spacer portion as at 29. The F-shaped tongue portion 28 comprises an inverted L-shaped portion having a primary riser portion as at 30 extending in the second bracket dimension and a primary upper support portion as at 31 extending in a third bracket dimension (as at dimension 103). The primary riser portion 30 is thus preferably orthogonal to the spacer portion 29, and the primary upper support portion 31 is preferable parallel to the spacer portion 29. The spacer portion 29 preferably extends in the third (bracket) dimension (as at dimension 103) for spacing and interconnecting the guide-cover attachment portion 24 (orthogonally) to the interface portion 23.

The guide-cover element 19 is preferably formed from a clearly anodized aluminum material and is extruded in a first (cover) dimension (i.e. dimension 101) for forming a guide-cover length in the first cover dimension. The guide-cover element 19 preferably comprises an inverted Π-shaped, channel portion as at 32, a shade-cover portion as at 33, and a shade-guide portion as at 34. The channel portion 32 is a bracket-attachment portion and preferably comprises a posterior extension portion as at 35, an anterior extension portion as at 36 and a spacer extension portion as at 37.

The posterior and anterior extension portions 35 and 36 are preferably parallel to one another extending in a second cover dimension (i.e. the second dimension 102) and interconnected via the spacer extension portion 37. The spacer extension portion 37 is preferably orthogonal to the posterior and anterior extension portions 35 and 36 extending in the third cover dimension (i.e. third dimension 103). The shade-cover portion 33 is preferably extruded in an arc length extending in the second and third cover dimensions radially anterior relative to the posterior extension portion 35. The shade-guide portion 34 is preferably planar and extruded so as to extend obliquely in the second and third cover dimensions sloped downwardly relative to the spacer extension portion 37.

The F-shaped tongue portion 28 further preferably comprises a secondary lower support portion or flange portion as at 42, which secondary lower support portion 42 is preferably parallel to the primary upper support portion 31. The upper and lower support portions 42 and 31 simultaneously contact or engage the inner wall 93 of the anterior extension portion 36 for preventing momentary rotation of the guide-cover element 19 relative to the bracket element 28 at the junction site therebetween.

The upper and lower support portions 42 and 31 are preferably spaced via the riser portion 30 so as to form a fastener-receiving channel as at 43. The fastener receiving channel 43 functions to (threadably) receive fasteners as at 44 via the anterior extension portion 36 for selectively fastening the guide-cover element 19 to the bracket element 18 at periodically spaced locations along or in the first dimension 101.

The interface portion 23 is preferably adhesively attachable to a vertical support structure such as a curtain wall or vertical portion of a superior transom or header element as at 12. Excellent results have been achieved utilizing 3M™ VHB™ Architectural Panel Tape G90F (VHB G90F, VHB Tape or Tape) as adhesive layer or adhesive mount as at 38 for adhesively attaching the interface portion 23 to the vertical support structure as exemplified by header element 12. The vertical support structure has a support structure plane as at 106, which support structure plane 106 is parallel to the window plane 100 and shade plane 105.

The furled portion 39 of the shade element 20 is received in the space 40 defined radially inwardly by the shade-cover portion 33. The axis fixing means basically function to fix the shade axis of rotation 100 radially central relative to the shade-cover portion 33. The guide-cover element 19 with element-mounted shade assembly are together attachable to the support-mounted bracket element 18 such that the F-shaped tongue portion 28 is received in the channel portion 32 akin to a tongue (e.g. F-shaped tongue portion 28) and groove (channel portion 32) assembly.

The shade-guide portion 34 is preferably sloped downwardly relative to the spacer extension portion 37 for slope-guiding the unfurled portion 14 of the shade element 20 toward the planes 106 and 100 when unfurling. The shade-guide portion 34 terminates posteriorly at a guide-cover terminus or lip 41 situated in inferior adjacency to the interface portion 23 when in an assembled state. The guide-cover terminus 41 and planar region 45 of the shade-guide portion 34 may be preferably outfitted with certain friction reduction means for reducing friction between the unfurling shade element 14 and the shade-guide portion 34 and ensuring or enhancing uniform shade element 20 unfurlment.

Figure 22:
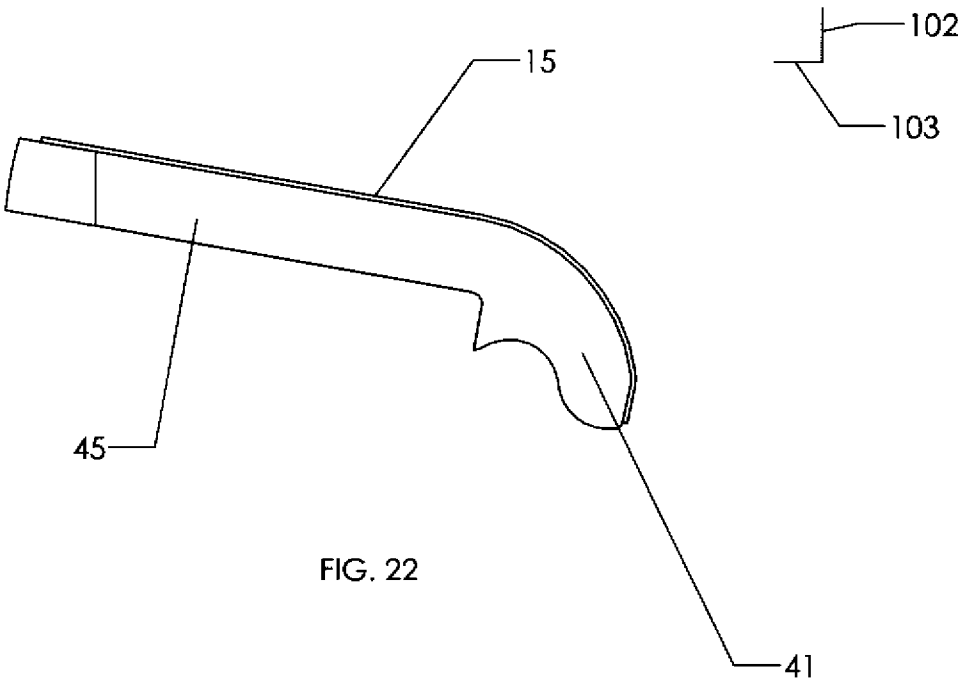
FIG. 22 is an enlarged fragmentary sectional end view depiction of a guide-cover terminus or lip of a guide-cover element according to the present invention as sectioned from FIG. 22(A).
Figure 22:
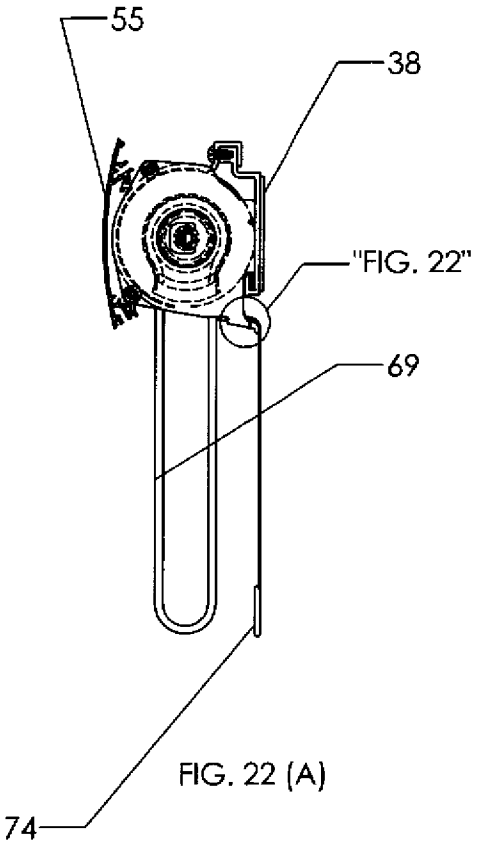
Figure 23:
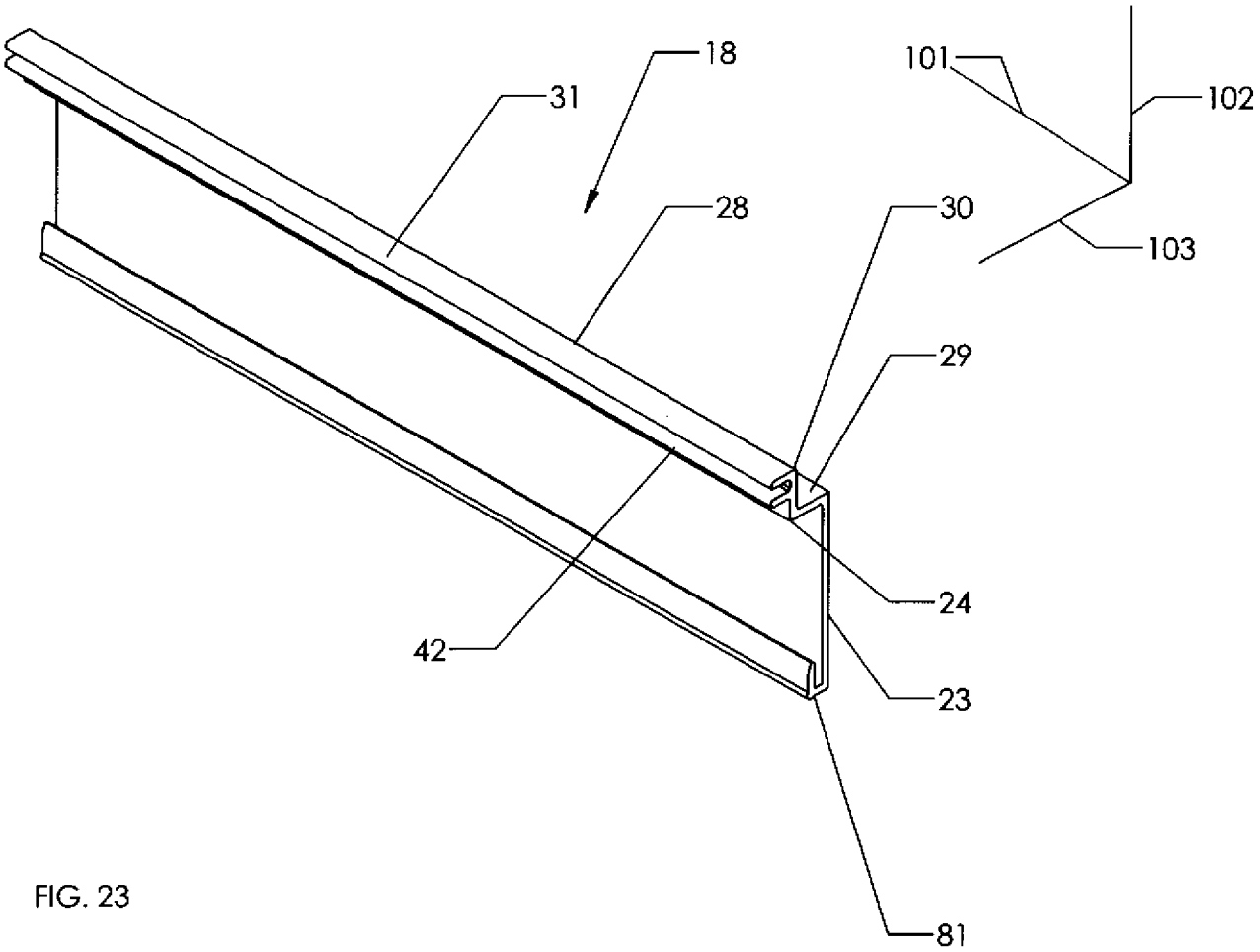
FIG. 23 is a top first end anterior perspective view of a preferred shade bracket element according to the present invention.
Figure 24:
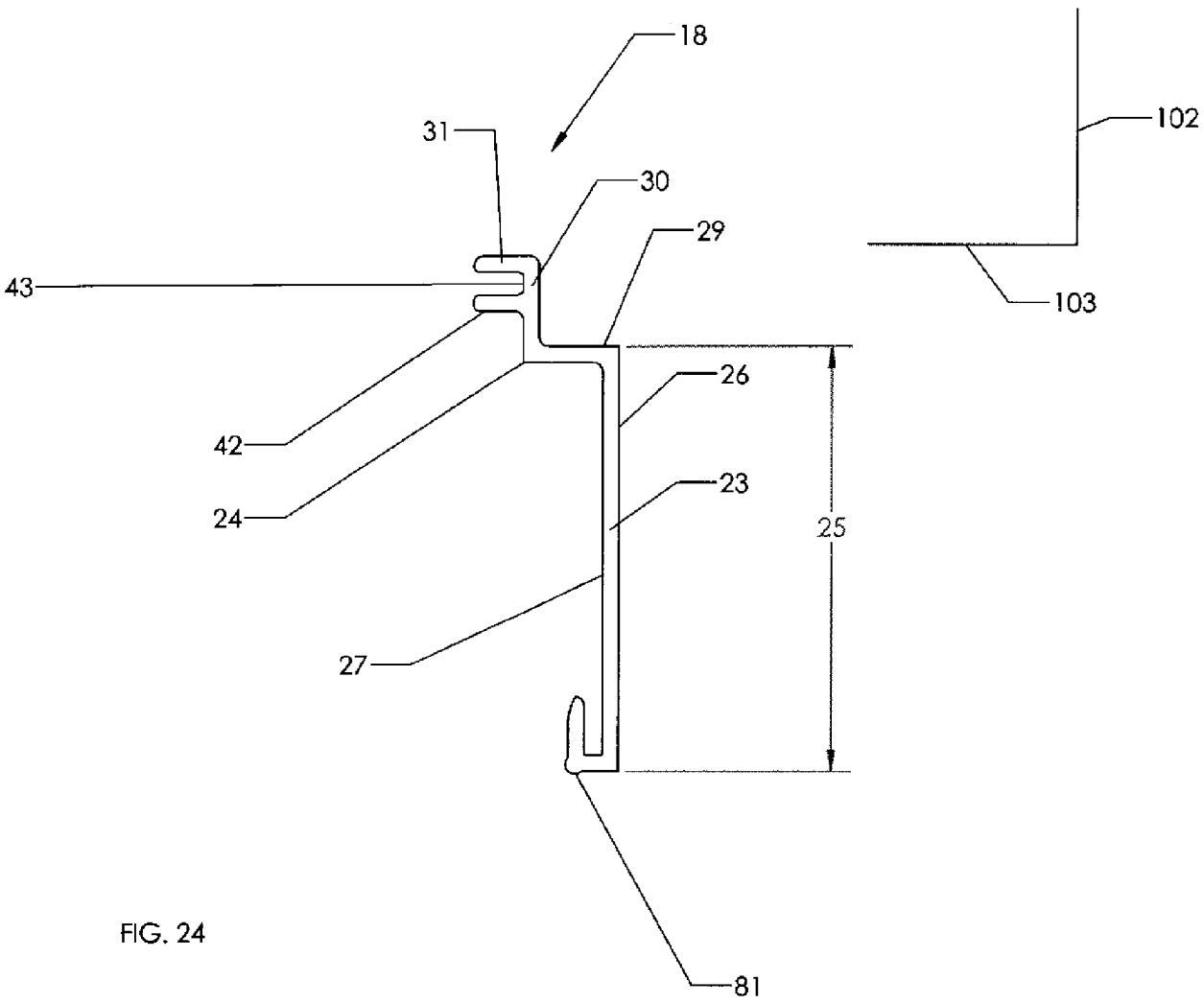
FIG. 24 is an enlarged first end elevational view of the preferred shade bracket element according to the present invention.
Figure 25:
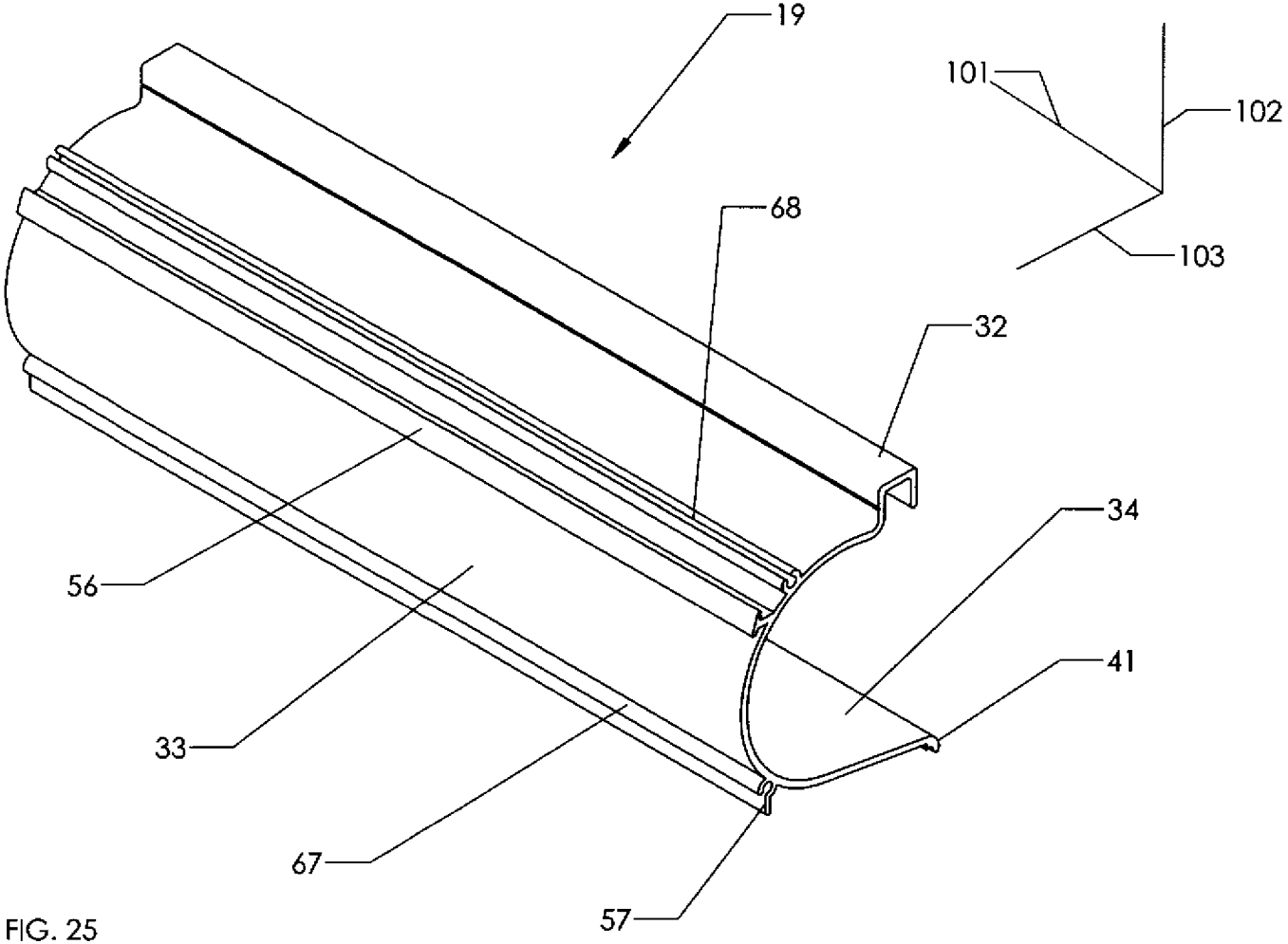
FIG. 25 is a top first end anterior perspective view of a guide-cover element according to the present invention.
Figure 26:
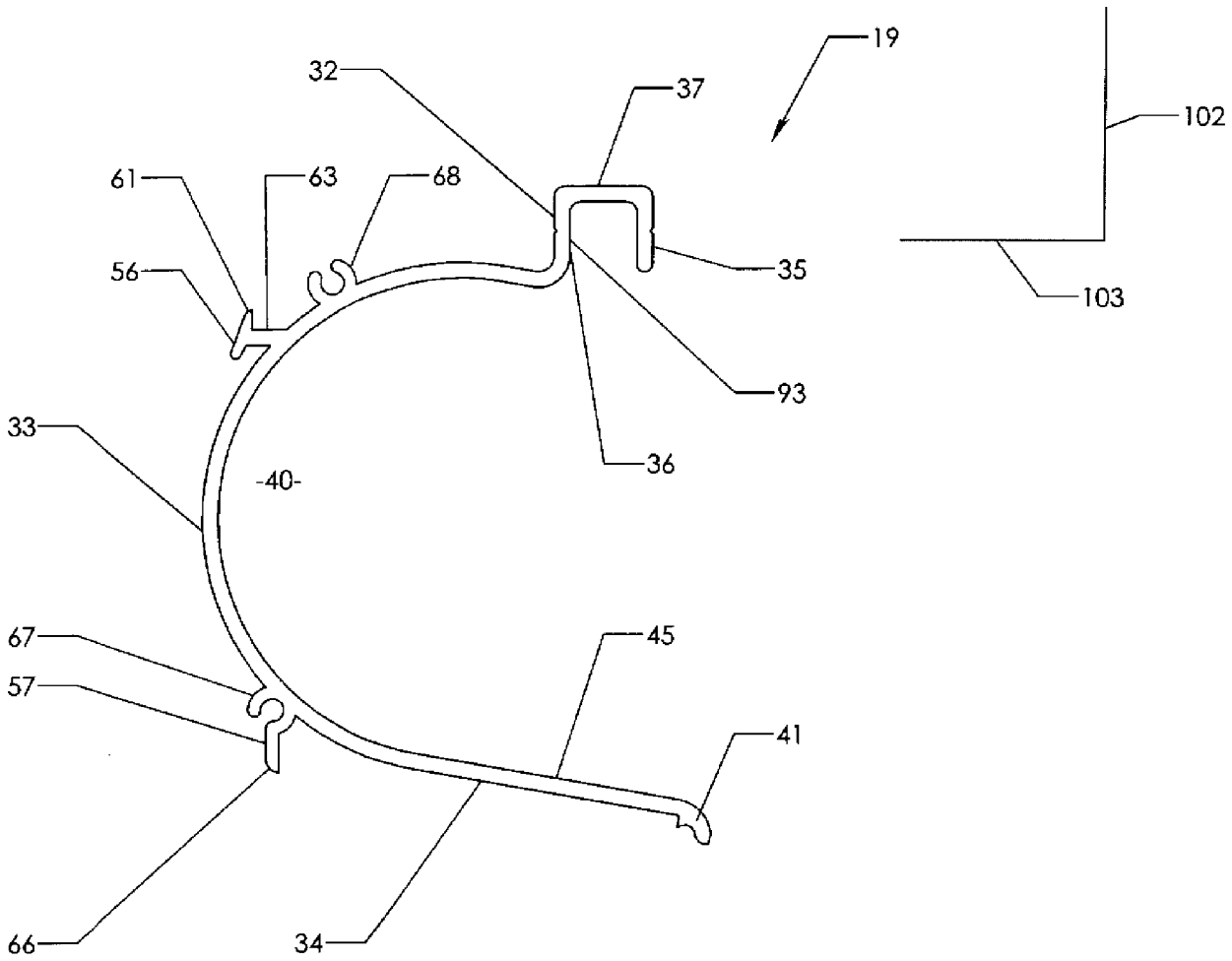
FIG. 26 is an enlarged first end elevational view of the guide-cover element according to the present invention.
Figure 27:
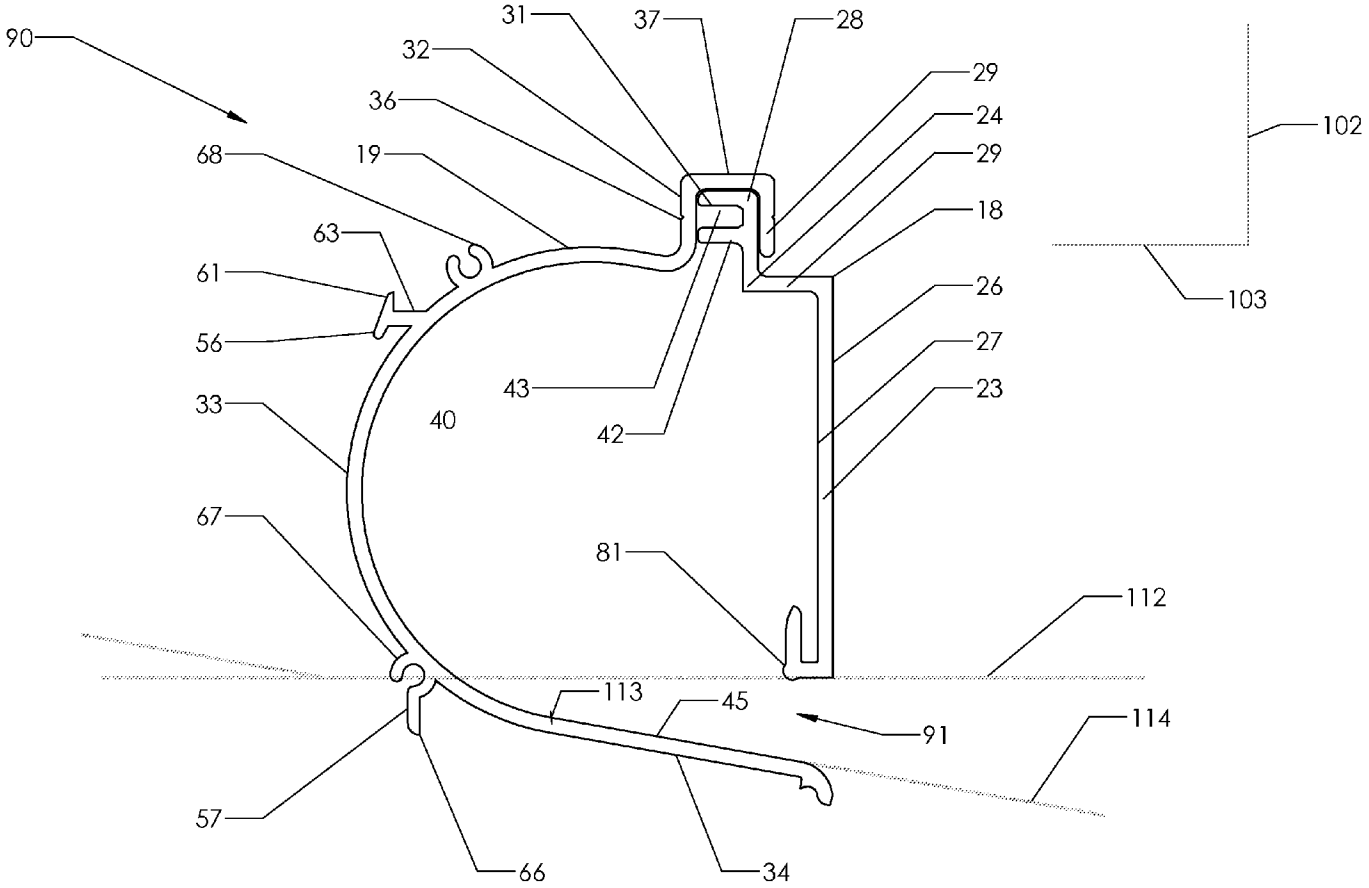
FIG. 27 is an enlarged first end elevational view of the guide-cover element assembled with the preferred shade bracket element according to the present invention.
Figure 28:
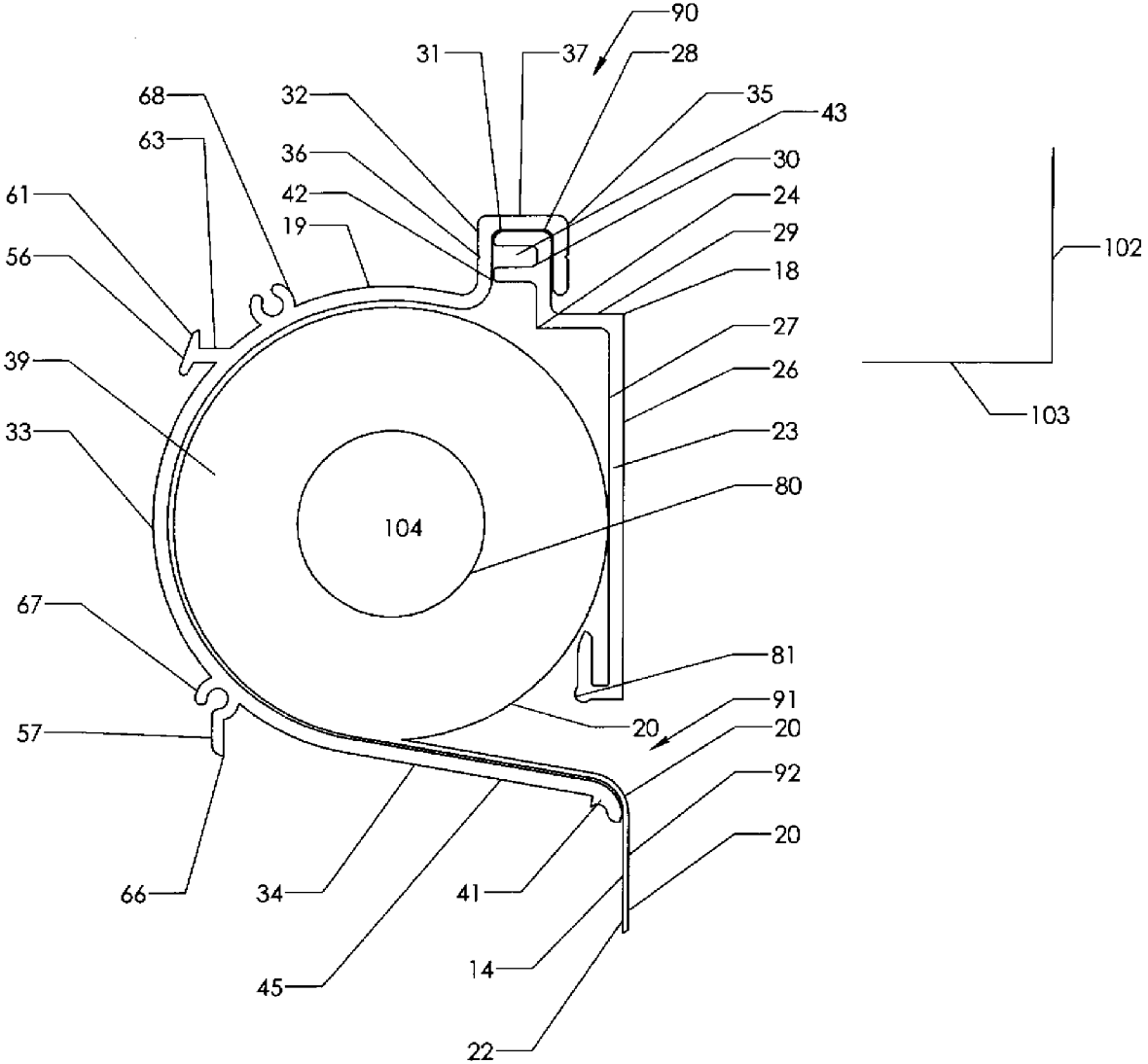
FIG. 28 is an enlarged first end elevational view of the guide-cover element assembled with the preferred shade bracket element with a shade element received within the space defined by the guide-cover and shade bracket elements according to the present invention with a fragmentary unfurled portion of the shade element extending downwardly from the furled portion of the shade element via the assembled guide-cover and shade bracket elements.
Figure 29:
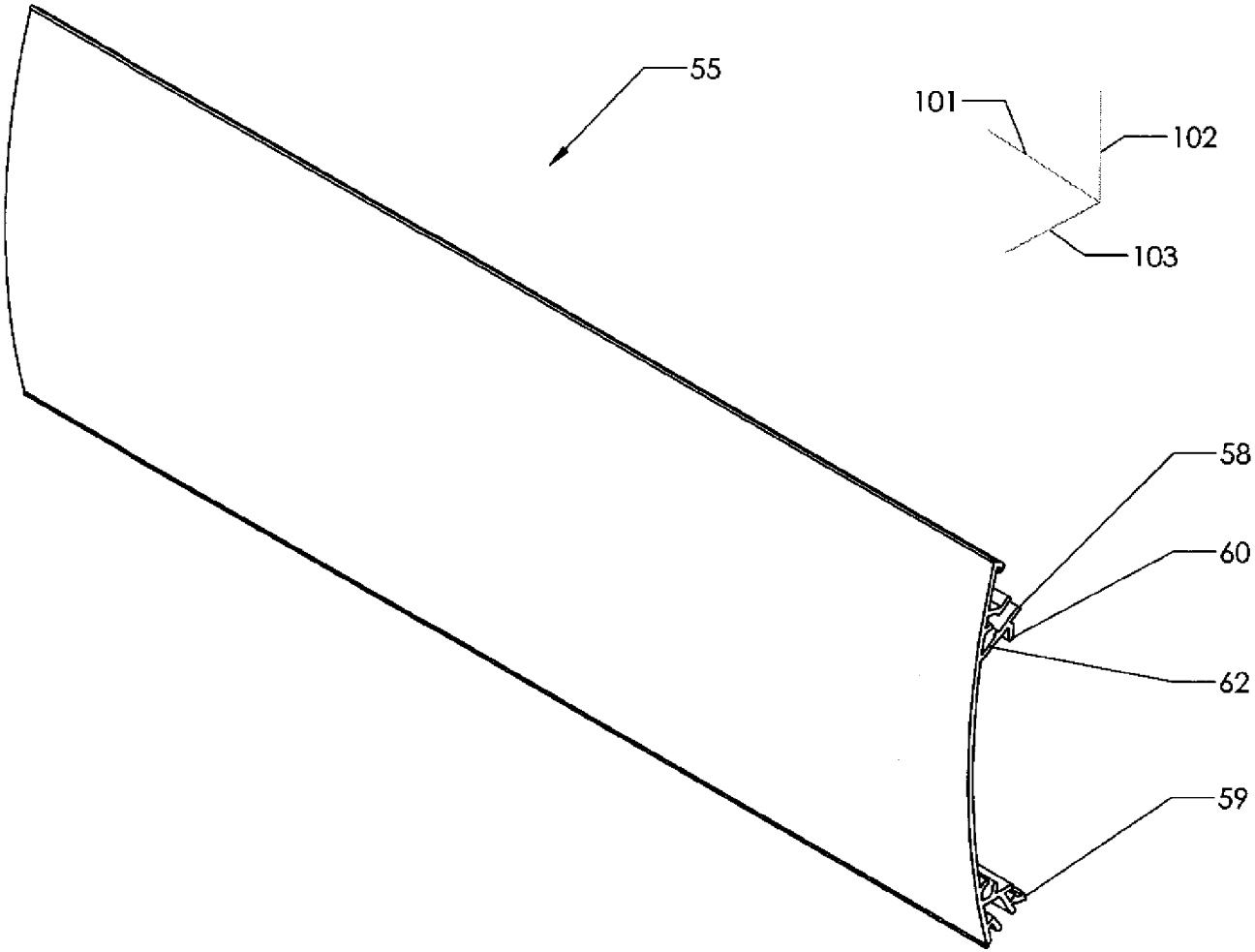
FIG. 29 is a top first end anterior perspective view of a valance cover element according to the present invention.
Figure 30:
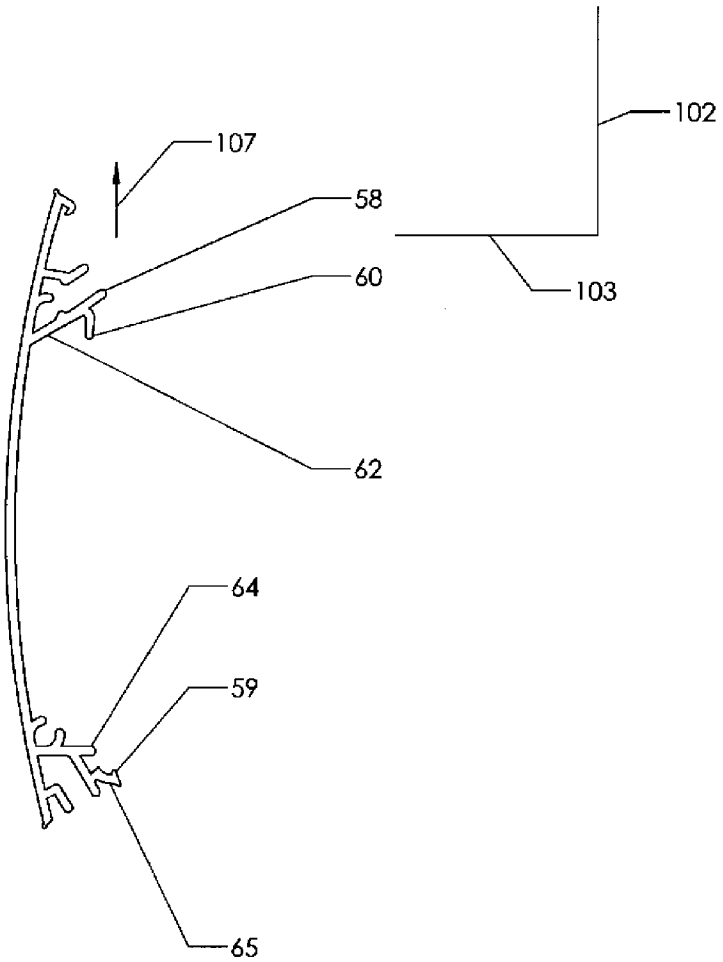
FIG. 30 is an enlarged first end elevational view of the valance cover element according to the present invention.
Figure 31:
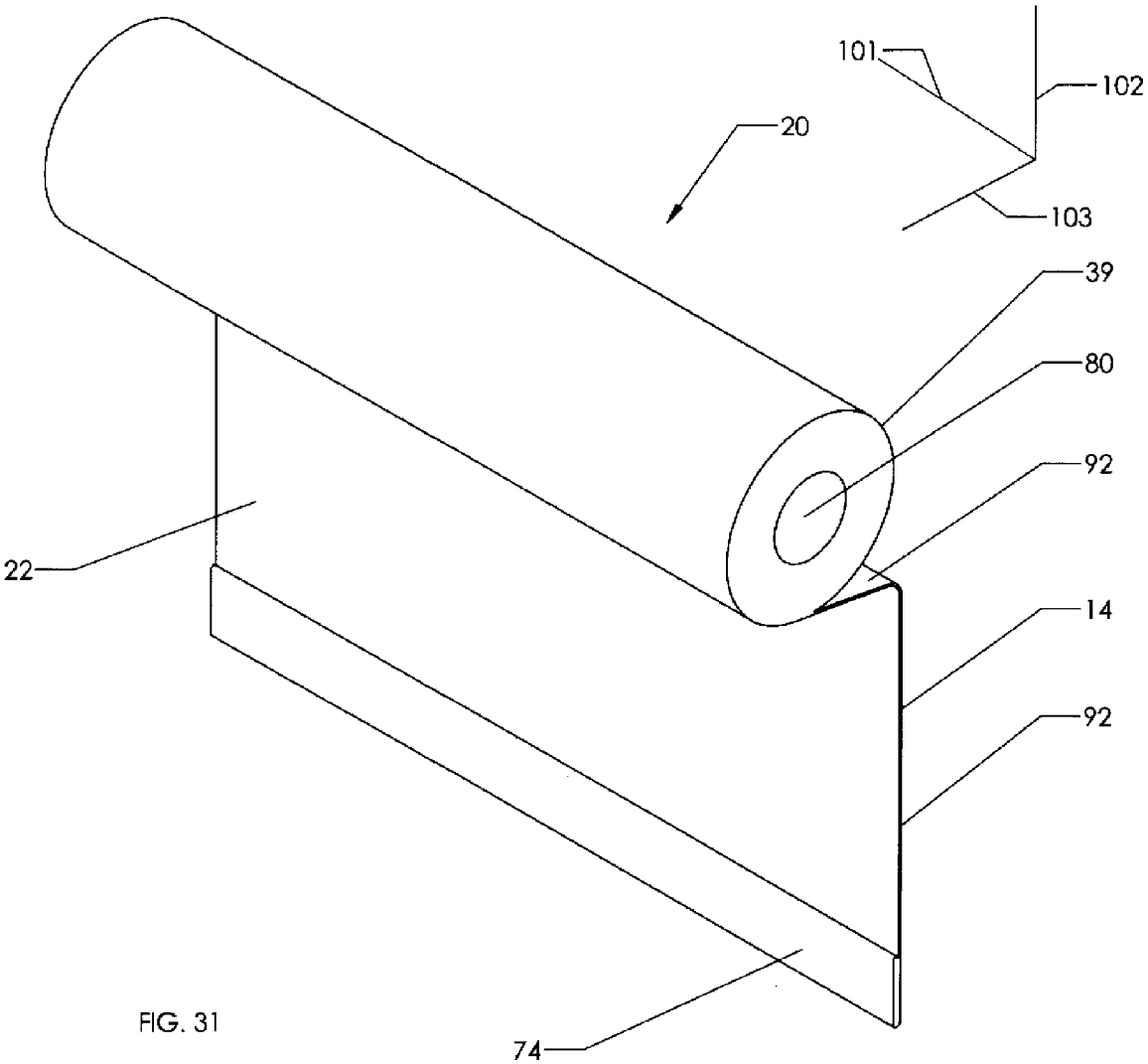
FIG. 31 is a top first end anterior perspective view of a shade element according to the present invention showing both furled and unfurled portions of the shade element.
Figure 32:
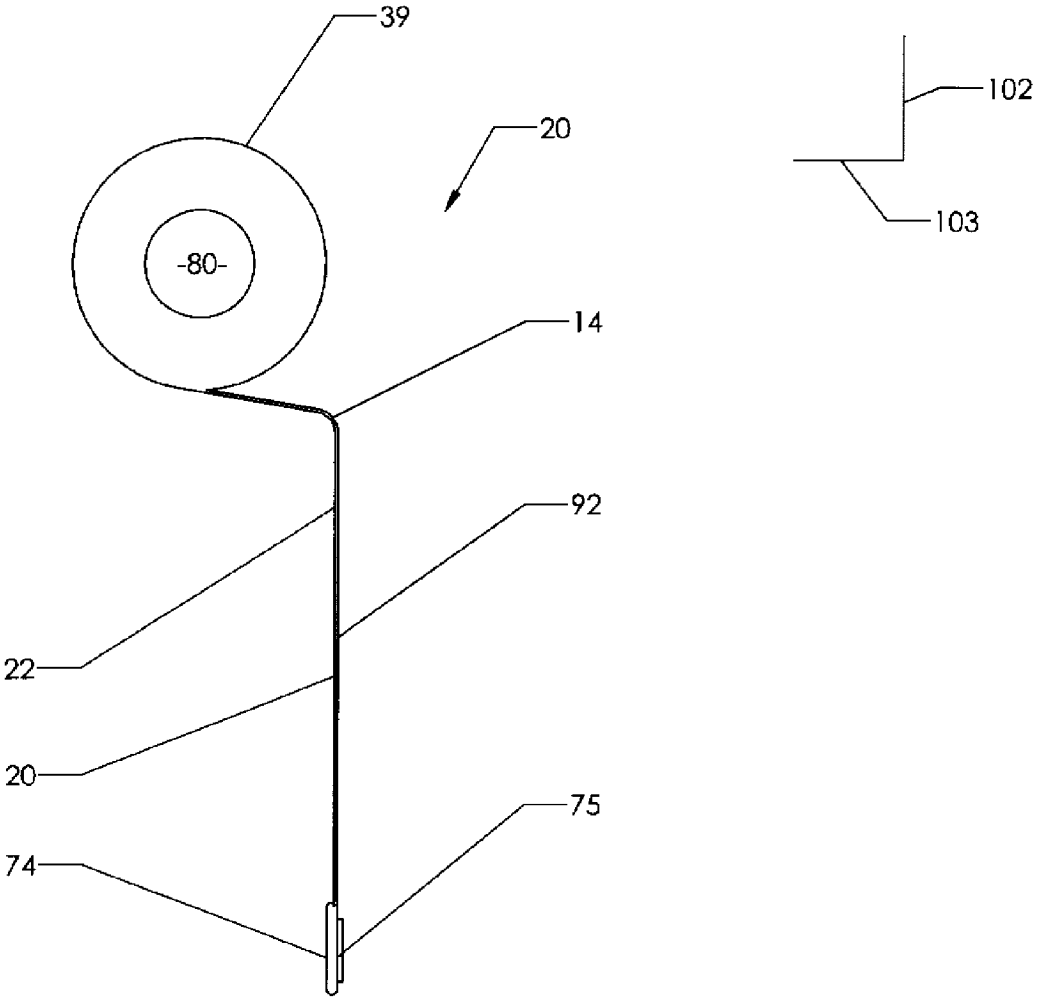
FIG. 32 is an enlarged first end elevational view of the shade element according to the present invention showing both furled and unfurled portions of the shade element, the lower end being outfitted with a bottom hem bar, which bar is magnetically attached to a fragmentary magnetic anchor construction.
Figure 33:
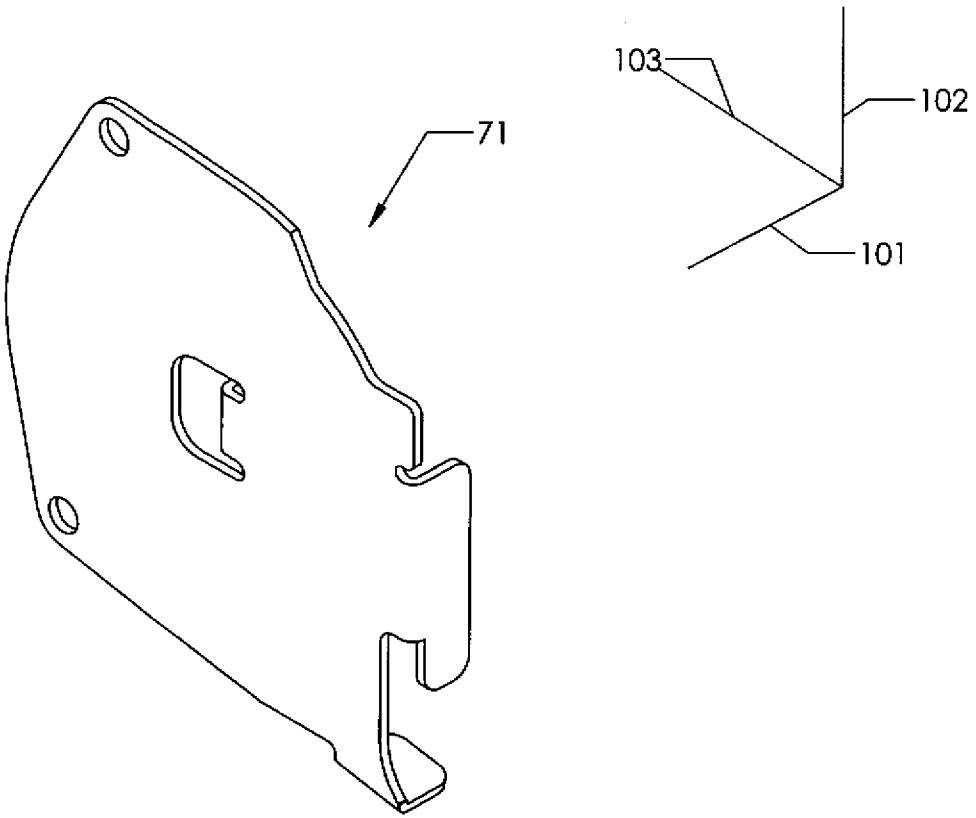
FIG. 33 is an enlarged top outer perspective view of a first end cap unit or element according to the present invention.
Figure 34:
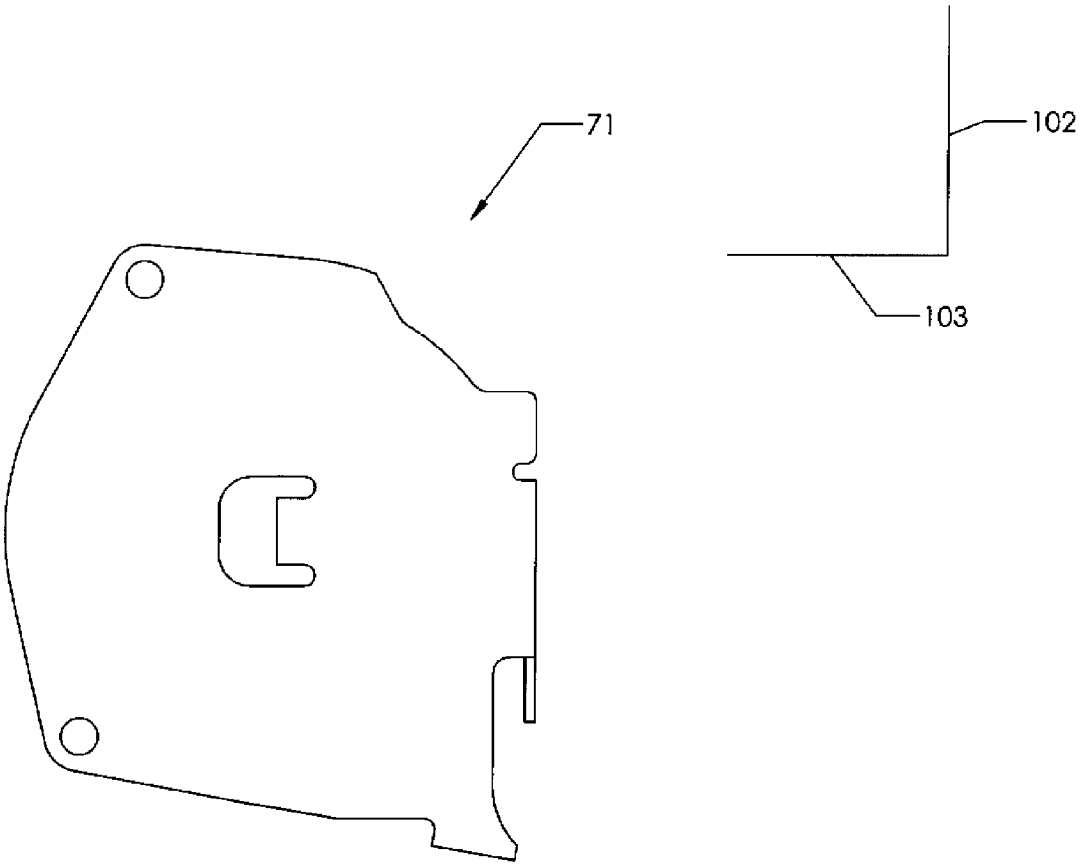
FIG. 34 is an enlarged outer plan view of the first end cap unit or element according to the present invention.
Figure 35:
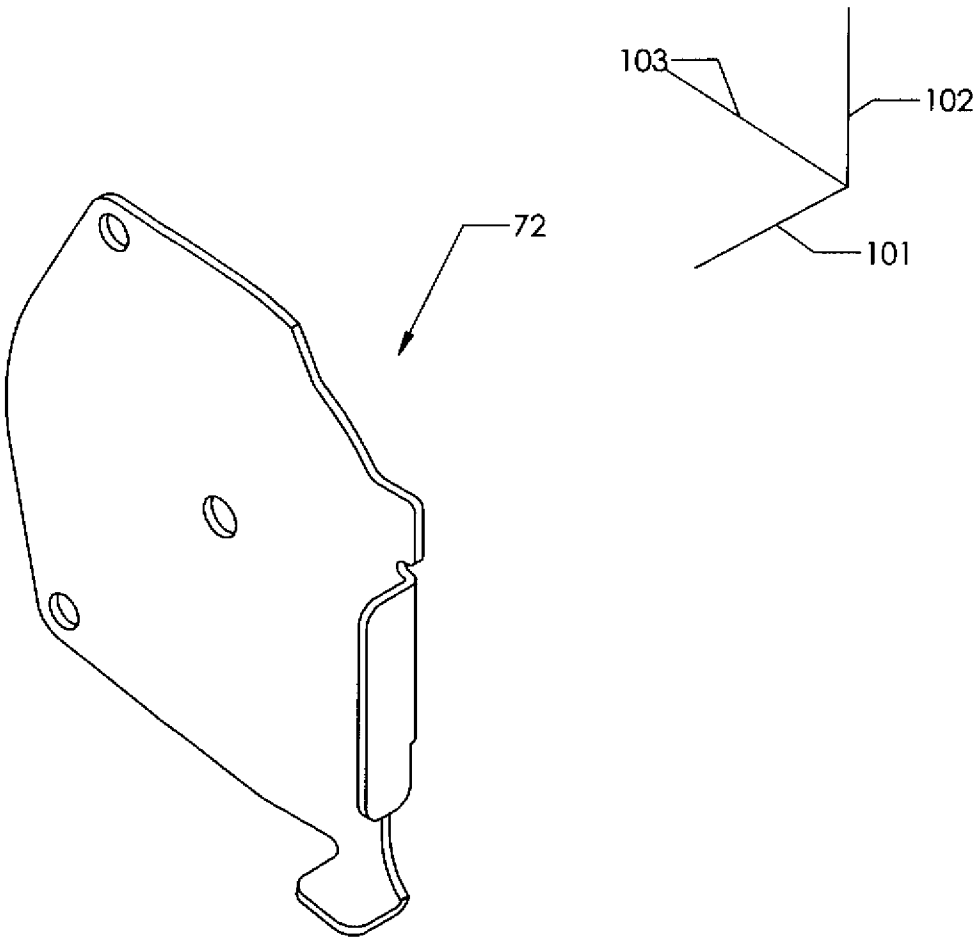
FIG. 35 is an enlarged top inner perspective view of a second end cap unit or element according to the present invention.
Figure 36:
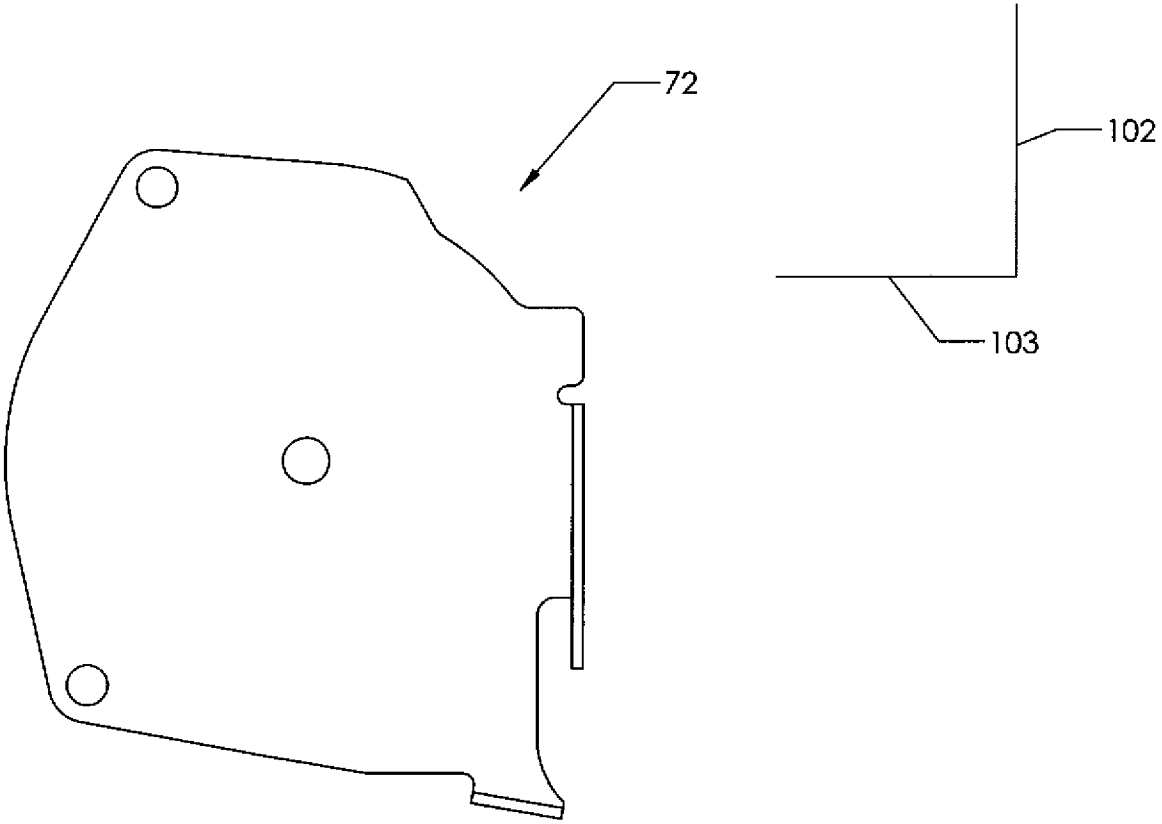
FIG. 36 is an enlarged inner plan view of the second end cap unit or element according to the present invention.
Figure 37:
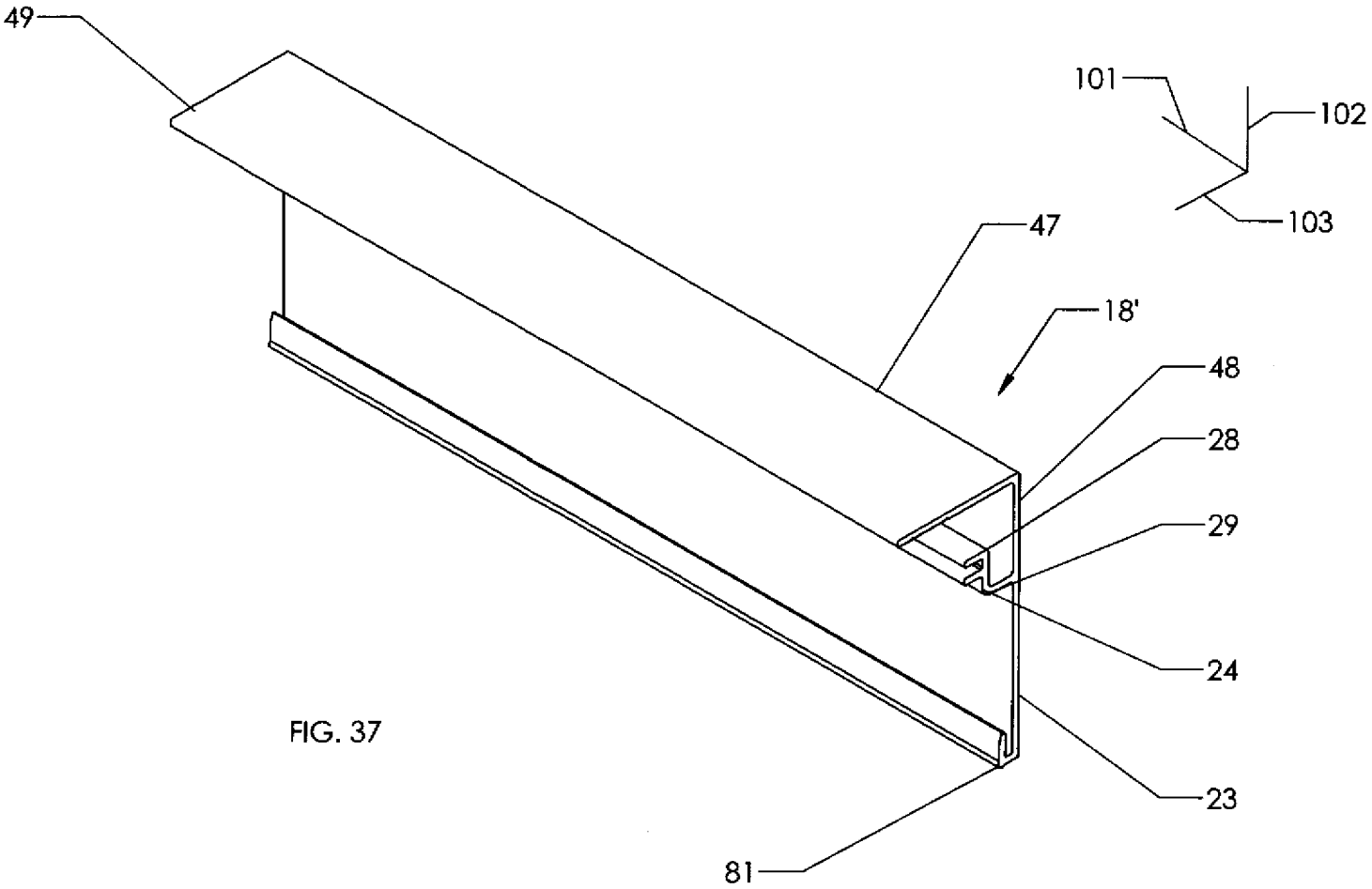
FIG. 37 is a top first end anterior perspective view of a first alternative shade bracket element according to the present invention.
Figure 38:
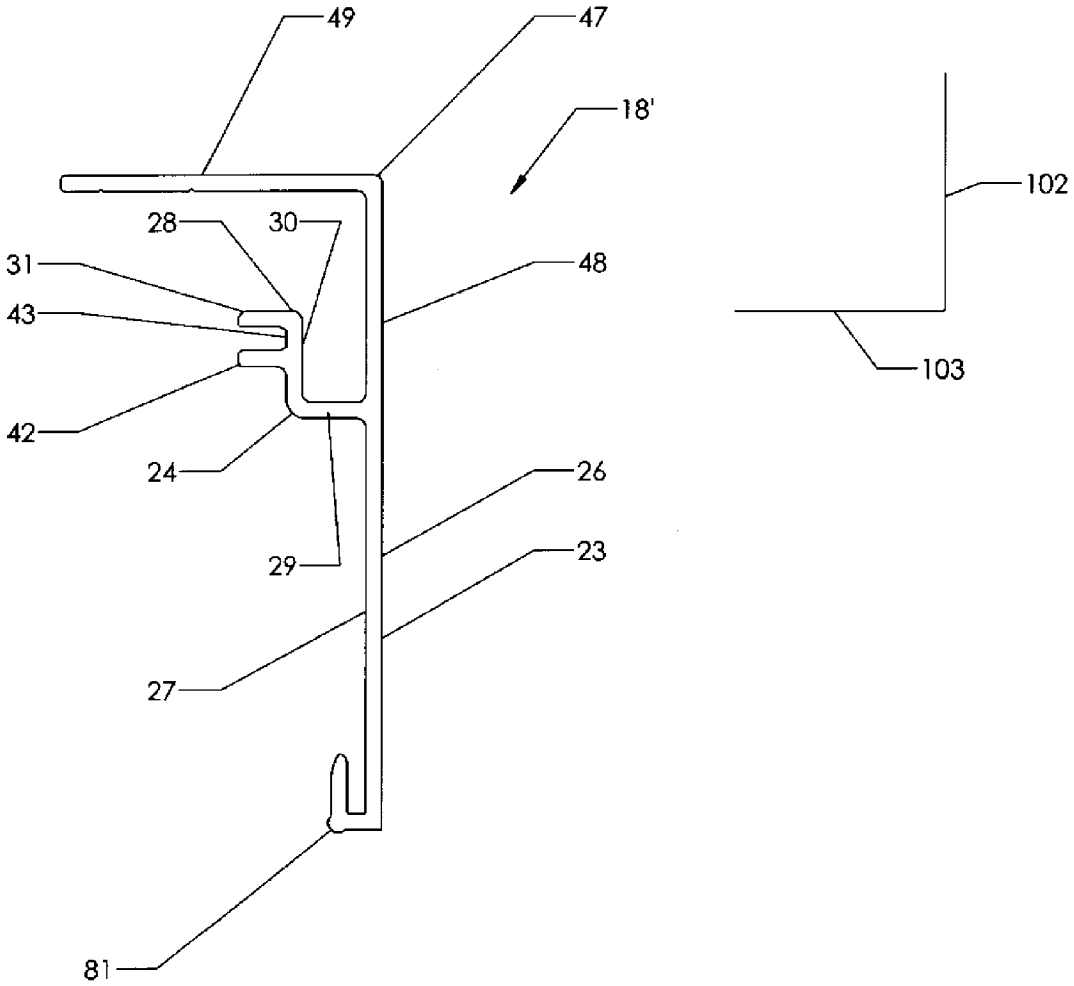
FIG. 38 is an enlarged first end elevational view of the first alternative shade bracket element according to the present invention.
Figure 39:
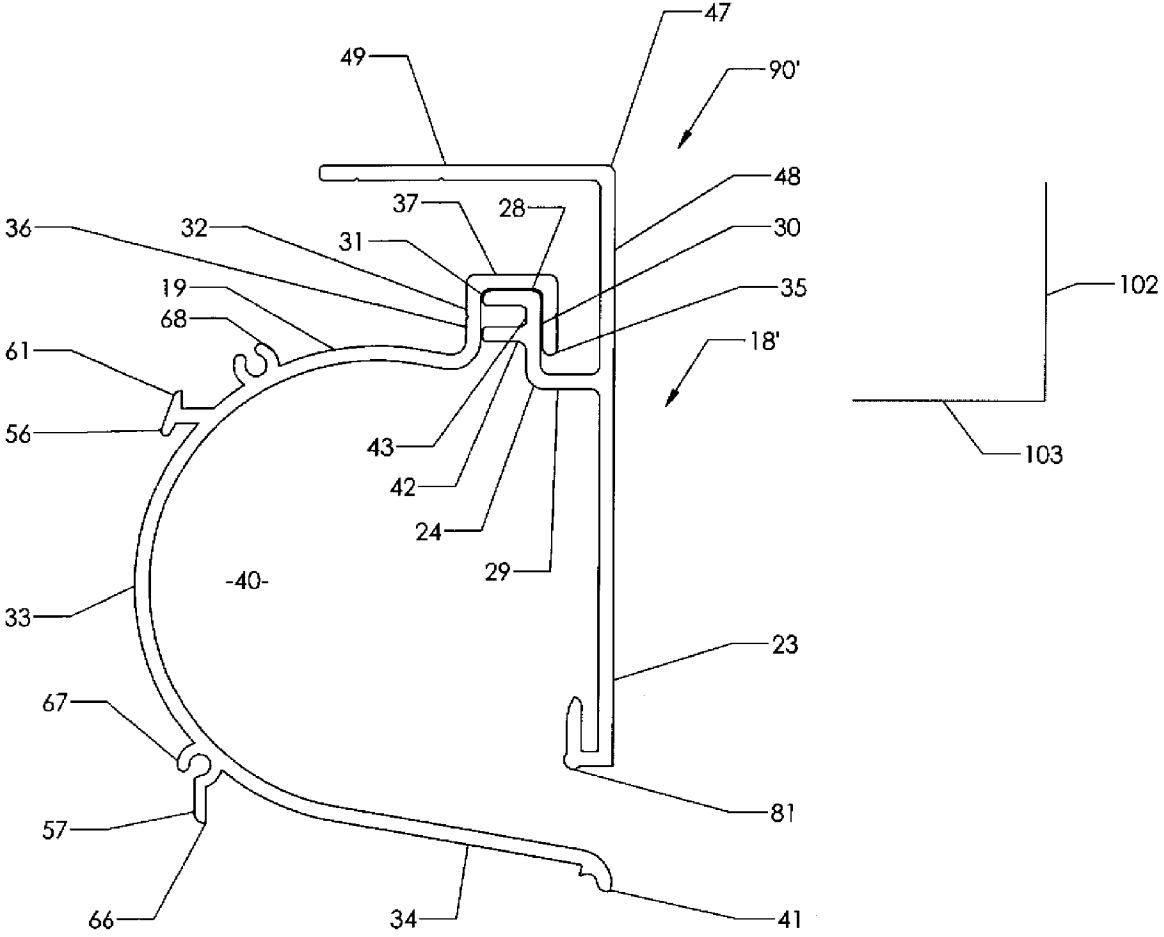
FIG. 39 is an enlarged first end elevational view of the guide-cover element assembled with the first alternative shade bracket element according to the present invention.

The friction reduction means may be preferably exemplified by a low friction adhesive tape or application as at 15 in FIG. 22. The unfurled portion 14 of the shade element 20 is extendable in the shade plane 105 parallel to the window plane 100 via the guide-cover terminus 41 for selectively shading the window material 10 from an exterior thermal load as at 110 when extended downwardly from the guide-cover terminus 41. The unfurled portion 14 of the shade element 20 thus functions block light and/or heat transfers into the building as diagrammatically depicted at curved arrows 111.

In the second alternative embodiment, the bracket element as at 18' is substantially identical to bracket element 18 but preferably further comprises an L-shaped upper support attachment portion as at 47, which upper support attachment portion 47 preferably comprises a secondary riser portion as at 48 and an upper support flange portion as at 49. The upper support flange portion 49 is preferably spaced from the primary upper support portion 31 for enabling the F-shaped tongue portion 28 to be received in the channel portion or bracket-attachment portion 32. The upper support flange portion 49 thereby provides certain flange means for attaching the alternative bracket element 18' to an upper support structure such as a ceiling structure as at 50 via fasteners as at 21.

In the third alternative embodiment, an L-shaped mullion mount element or header mount element as at 51 is separately included. The mullion or header mount element 50 is preferably extruded in a first mount dimension (i.e. the first dimension 101), and comprises a planar first mount portion as at 52 and a planar second mount portion (orthogonal to the first mount portion 52) as at 53. The first mount portion 52 is adhesively attachable to the interface portion 23 via the same or similar preferred adhesive material or layer 38, and the second mount portion 52 is preferably adhesively attachable to a horizontal window mullion structure as at 54 via adhesive material or layer 38.

The shade furling system or window shade system according to the present invention may further preferably comprise a valance element or valance construction as at 55. The valance element or construction 55 is cooperable with the guide-cover element 19 for concealing or covering the same. In this regard, the reader will note that the guide-cover element 19 preferably comprises an upper valence-engaging construction as at 56 and a lower valence-engaging construction as at 57, and that the valance element or construction 55 preferably comprises an upper cover-engaging construction as at 58 and a lower cover-engaging construction as at 59. The upper cover-engaging construction 58 engages and rests upon the upper valence-engaging construction 56, and the lower cover-engaging construction 59 engages the lower valence-engaging construction 57.

The upper cover-engaging construction 58 preferably comprises a downwardly formed flange element 60. The upper valence-engaging construction 56 comprises an upwardly formed flange element 61. The upper valence-engaging construction 56 is formed so as to be relatively rigid in overall construction, and the upper cover-engaging construction 58 is formed so as to be flexible in overall construction such that the main portion 62 of the construction 58 may be (a) flexed upwardly as at arrow 107 so as to enable the flange element 60 to pass flange element 61 and (b) relaxed as at arrow 108 to seat upon the extension portion 63 of the upper valence-engaging construction 56 and prevented from anteriorly directed movement via the upwardly formed flange element 61.

The lower cover-engaging construction 59 comprises a post as at 64, which presses against the side of the lower valence-engaging construction 57, and a resilient channel lock construction 65 which channel-receives and locks the lower cover-engaging construction 59 to the tip 66 of the lower valence-engaging construction 57. A lower fastener-receiving formation 67 may be preferably formed with the lower valence-engaging construction 57 for receiving an end cap-fastening fastener as at 84. Similarly, the anterior face of the guide-cover element 19 may be outfitted with an upper fastener-receiving formation 68 for also receiving end cap-fastening fasteners 84.

The shade furling or window shade system according to the present invention may further preferably comprise certain select means for furling and unfurling the shade element 20 of the shade assembly, which select means essentially differentiates the preferred (and second and third alternative) embodiment(s) from the first alternative embodiment. In this regard, it is contemplated that said select means may be preferably selected from the group consisting of user-powered or manually operable means and electrically-powered means for furling and unfurling the shade element 20 of the shade assembly.

Figure 8:
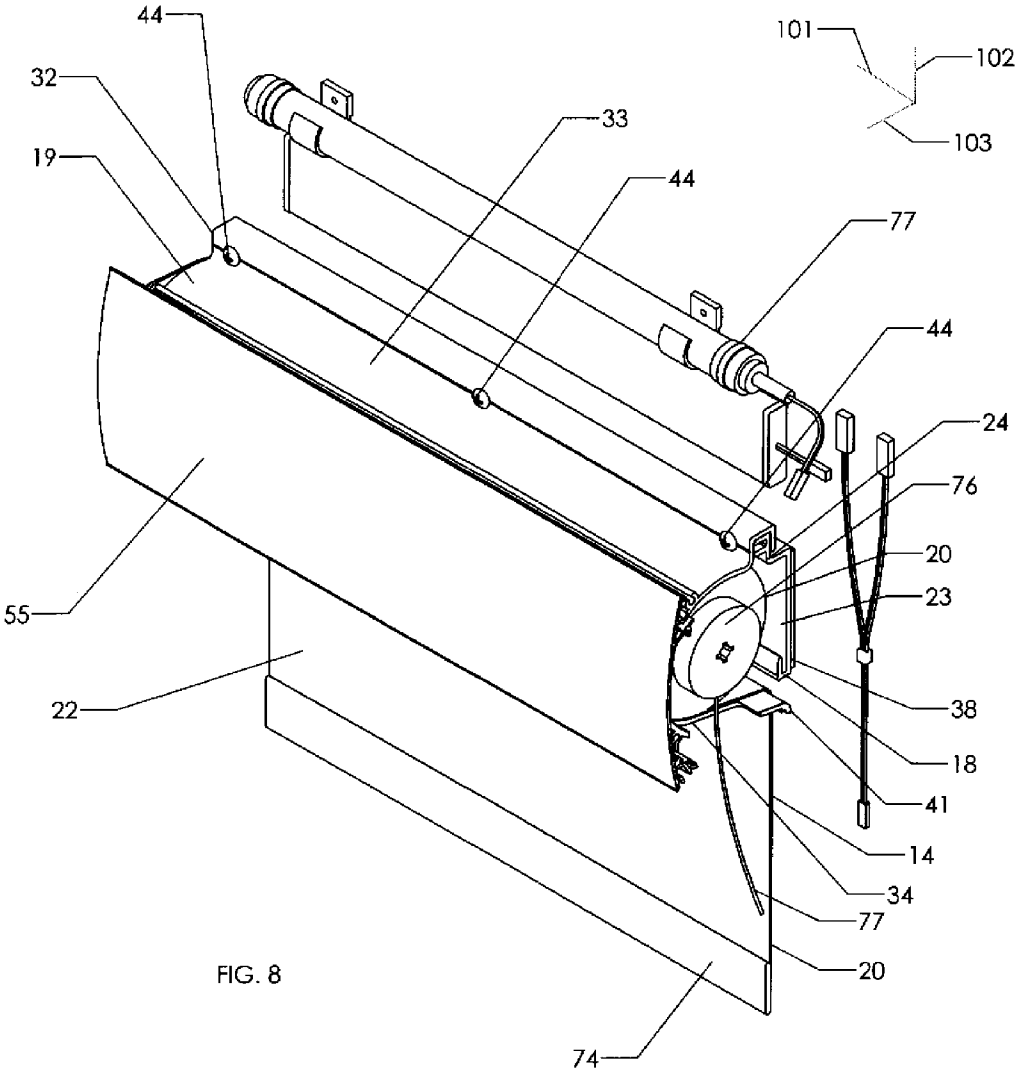
FIG. 8 is a top first end perspective view of the assembled first alternative window shade system or assembly according to the present invention with a first end cap unit removed from the system to show otherwise hidden inner components of the system.
Figure 9:
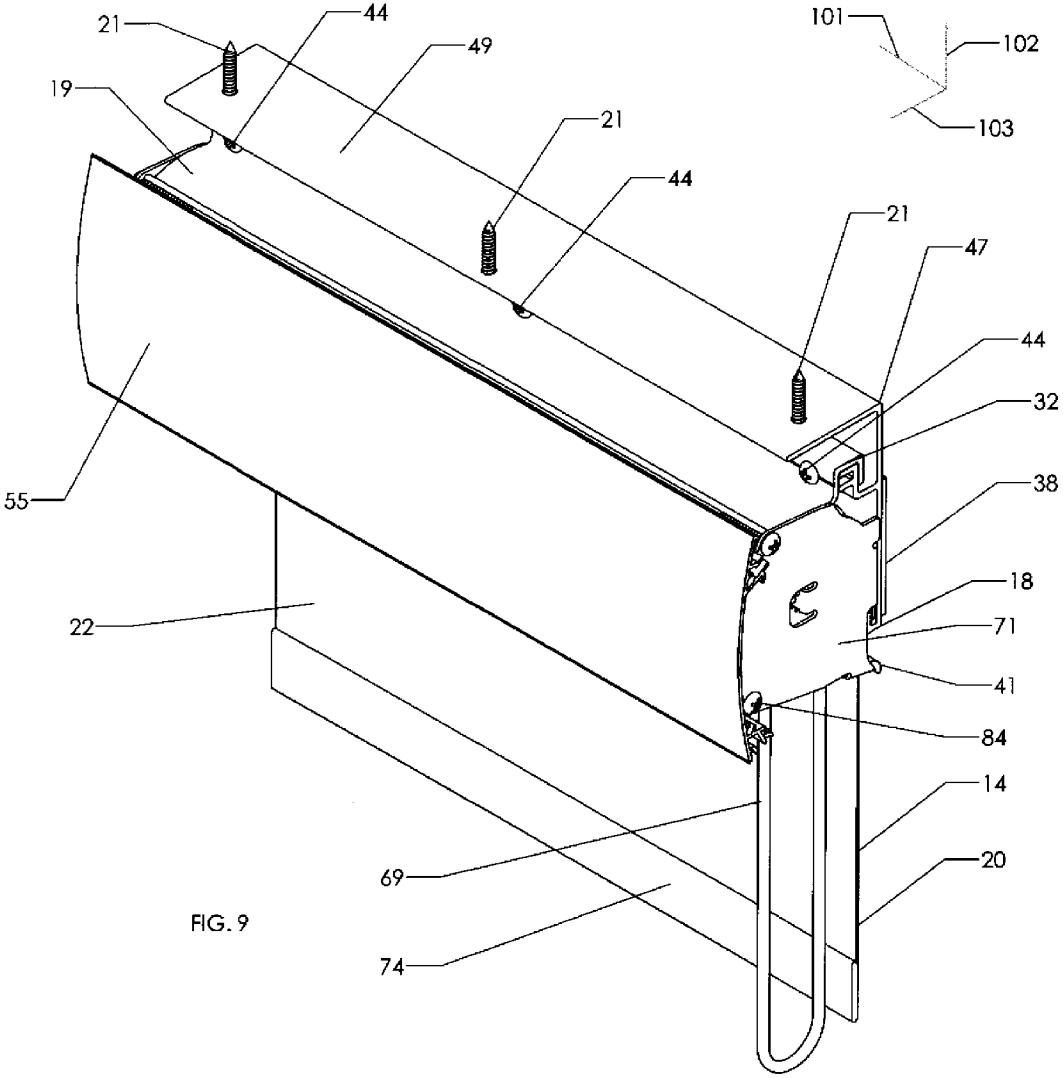
FIG. 9 is a top first end perspective view of a fully assembled second alternative window shade system or assembly according to the present invention with a first end cap unit assembled to the system or assembly.
Figure 10:
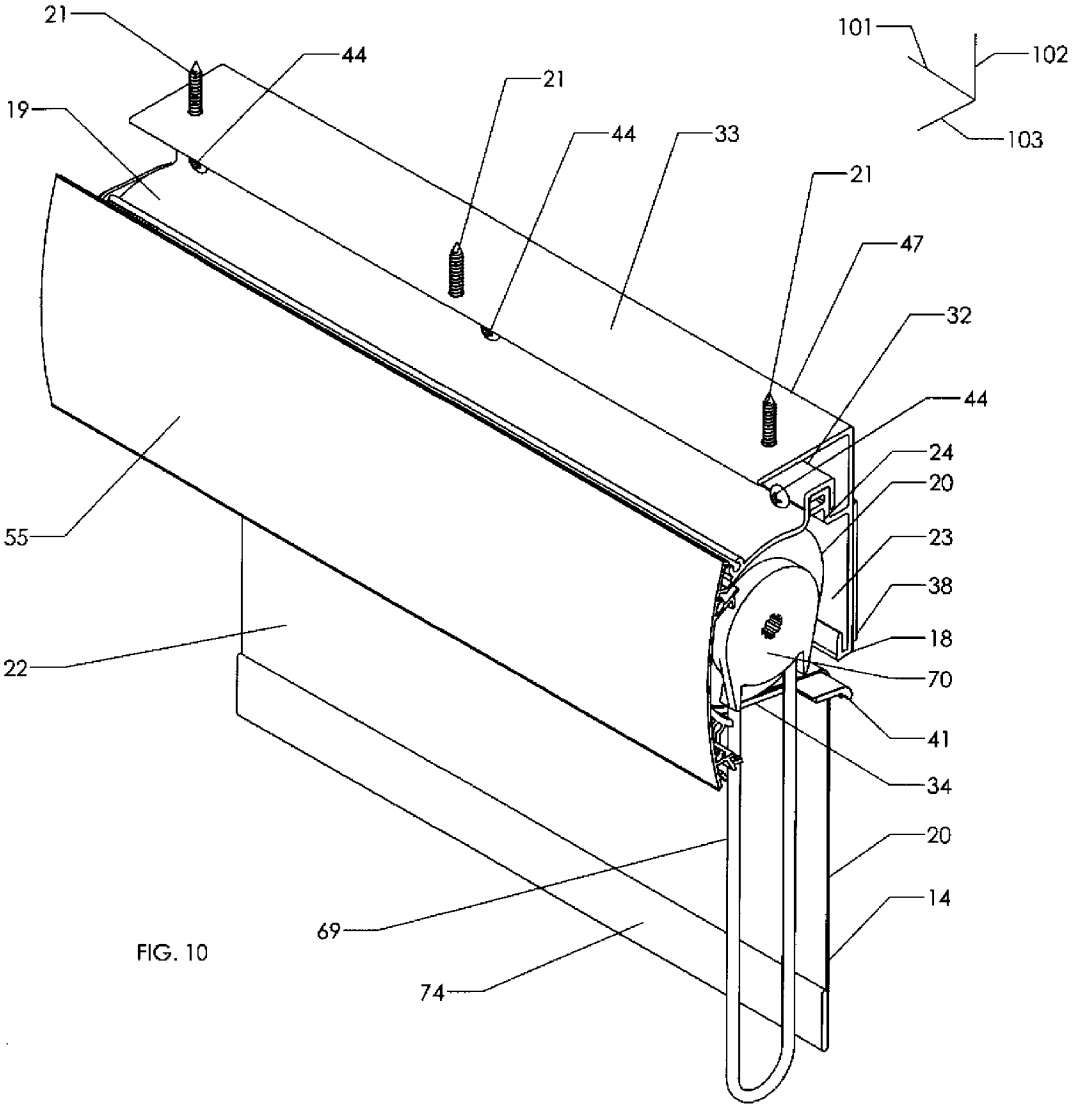
FIG. 10 is a top first end perspective view of an assembled second alternative window shade system or assembly according to the present invention with a first end cap unit removed from the system to show otherwise hidden inner components of the system or assembly.
Figure 11:
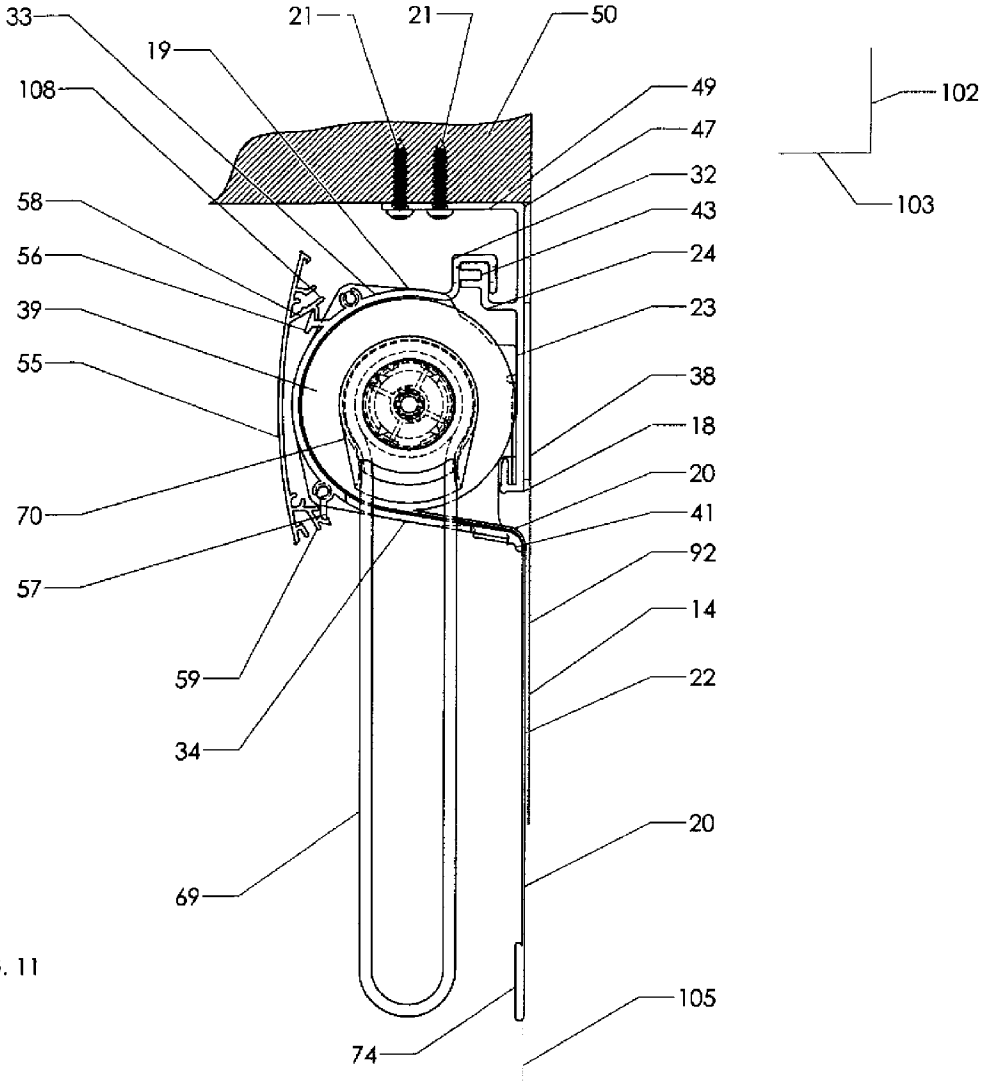
FIG. 11 is a first end elevational view of the assembled second alternative window shade system or assembly according to the present invention fastened to an upper ceiling construction with the first end cap unit removed from the system to show otherwise hidden inner components of the system or assembly.
Figure 13:
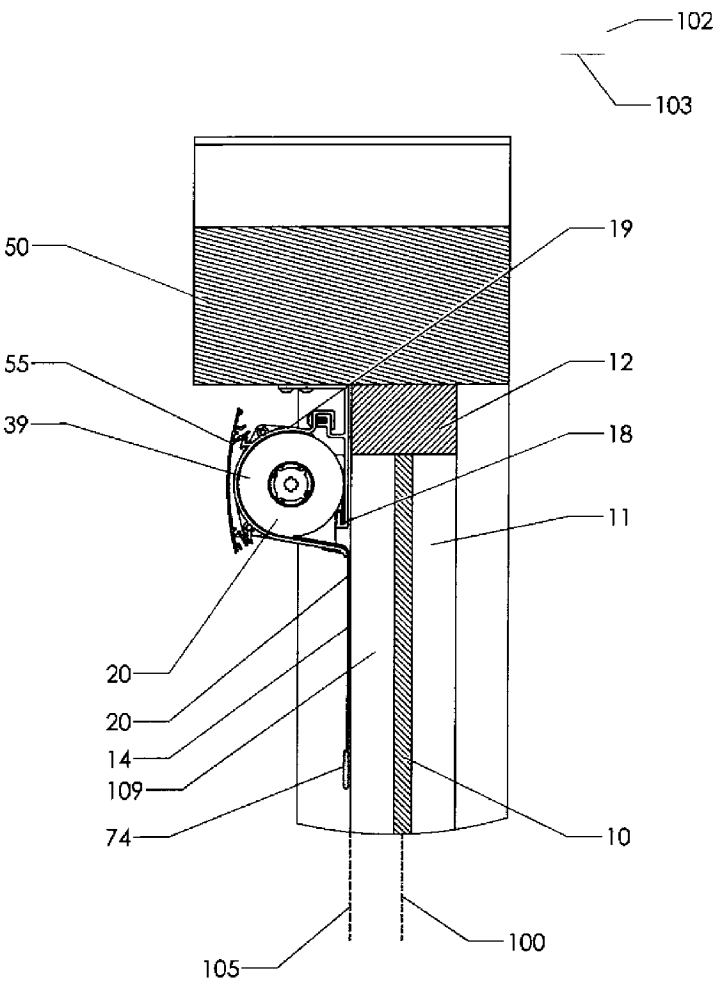
FIG. 13 is a reduced first end elevational view of the assembled second alternative window shade system or assembly according to the present invention with the first end cap unit removed from the system to show otherwise hidden inner components of the system as mounted to a ceiling structure and header element of a fragmentary window site shown in cross-section.
Figure 12:
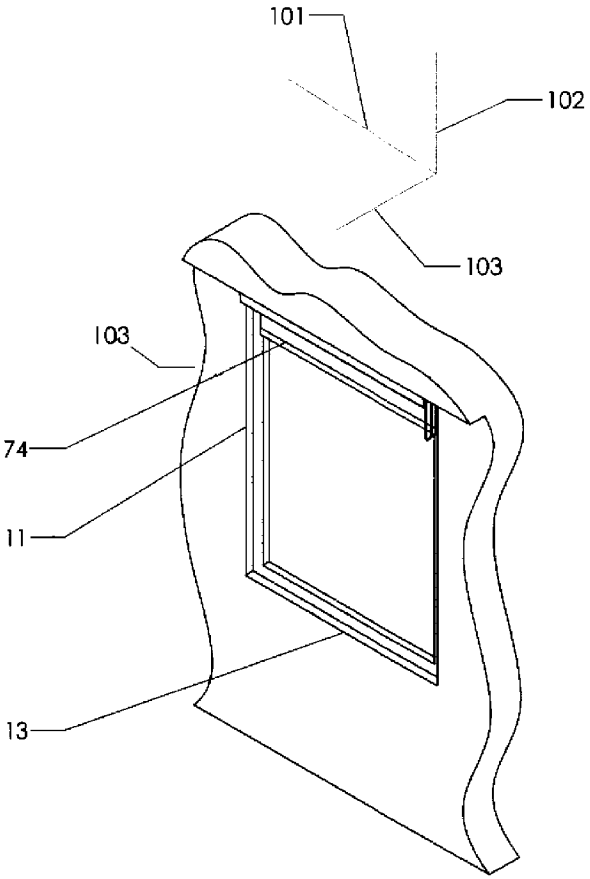
FIG. 12 is a reduced top first end perspective view of the second alternative window shade system or assembly according to the present invention as mounted at an exemplary window site of a fragmentary building construction.
Figure 14:
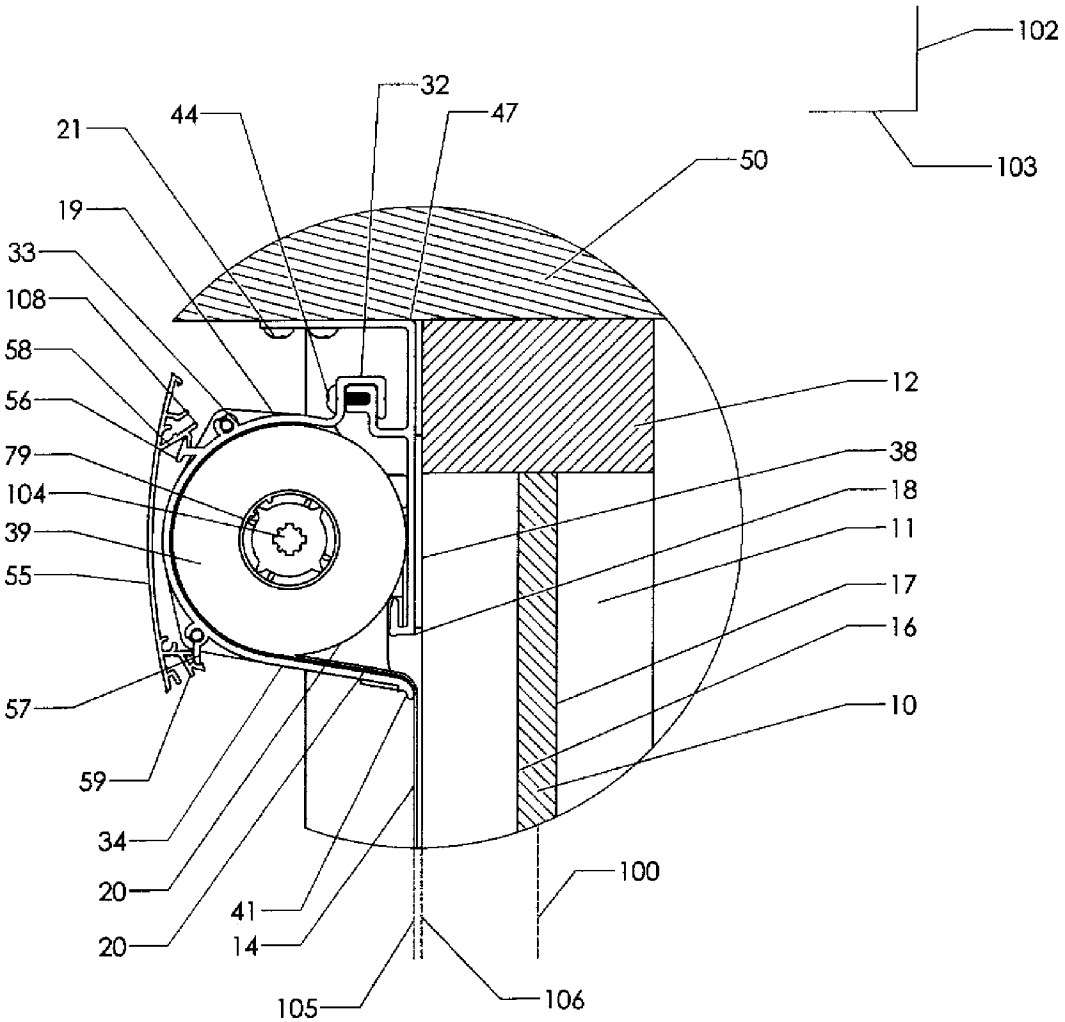
FIG. 14 is an enlarged first end view of a fragmentary assembled second alternative window shade system or assembly according to the present invention with the first end cap unit removed from the system to show otherwise hidden inner components of the system as mounted to a ceiling structure and header element of a fragmentary window site shown in cross-section.
Figure 15:
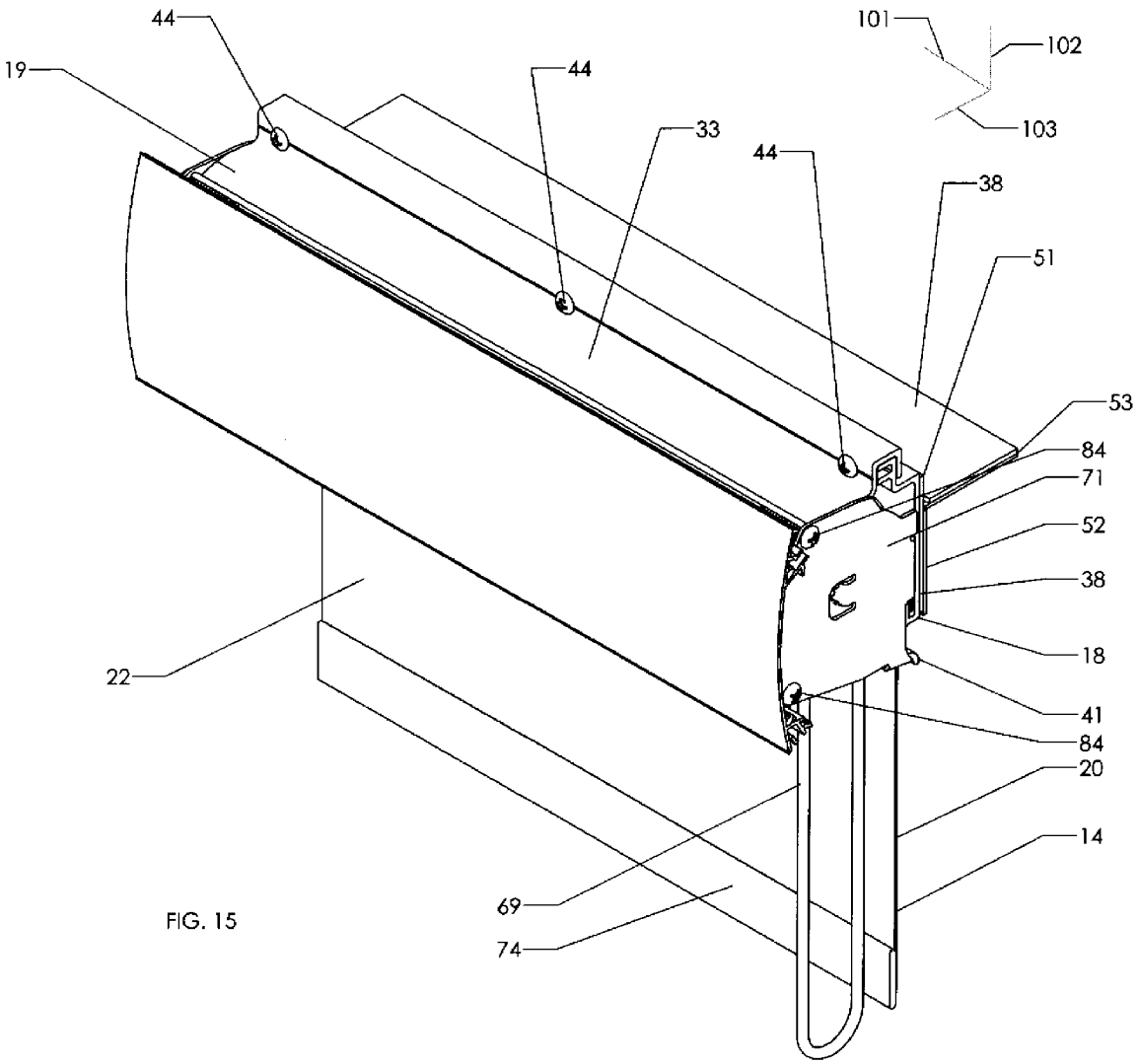
FIG. 15 is a top first end perspective view of a fully assembled third alternative window shade system or assembly according to the present invention with a first end cap unit assembled to the system or assembly.
Figure 16:
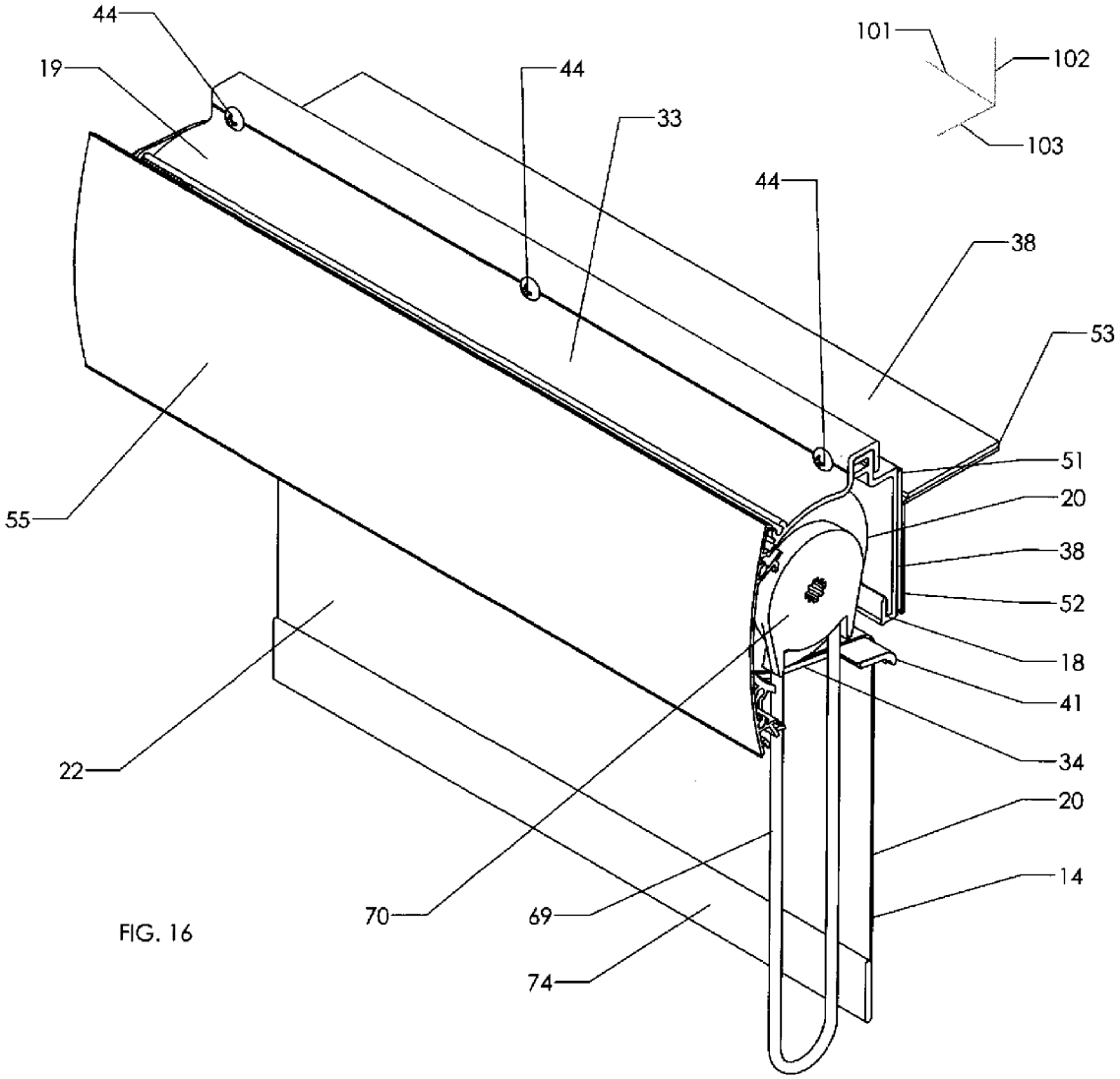
FIG. 16 is a top first end perspective view of an assembled third alternative window shade system or assembly according to the present invention with a first end cap unit removed from the system to show otherwise hidden inner components of the system or assembly.
Figure 17:
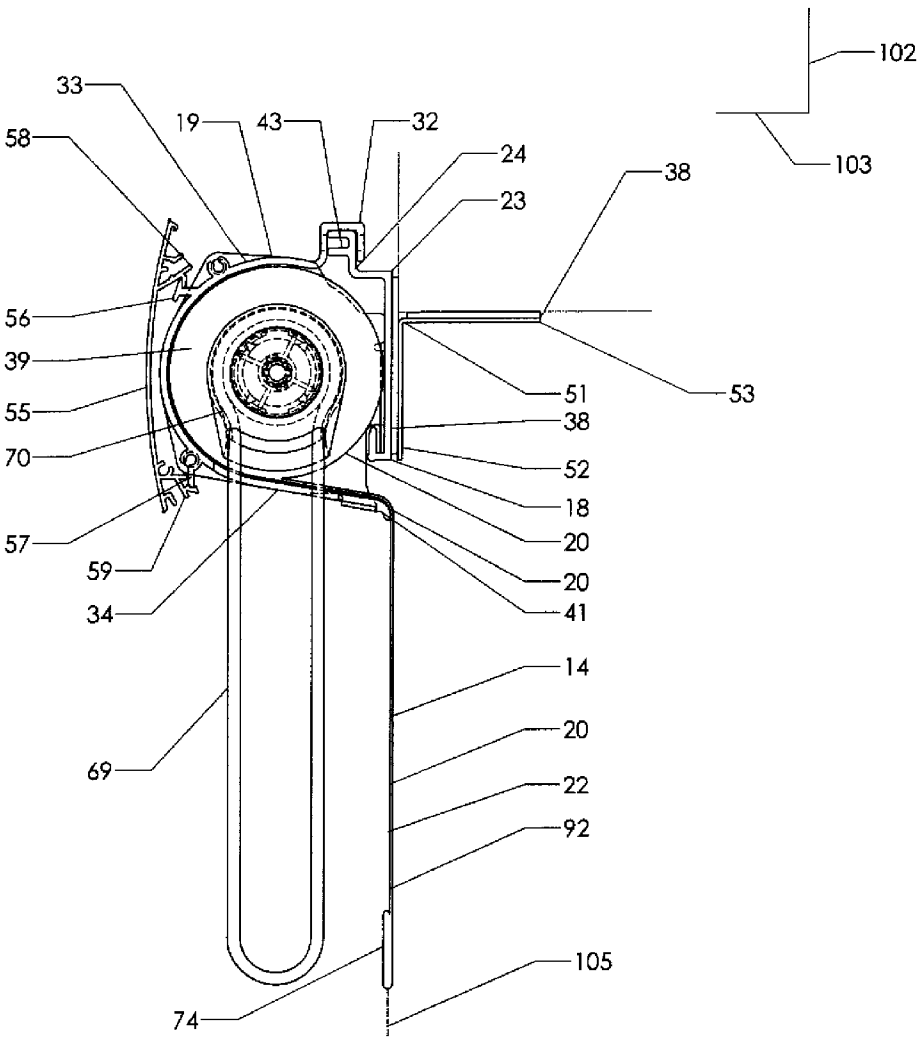
FIG. 17 is a first end elevational view of the assembled third alternative window shade system or assembly according to the present invention with the first end cap unit removed from the system to show otherwise hidden inner components of the system or assembly.
Figure 19:
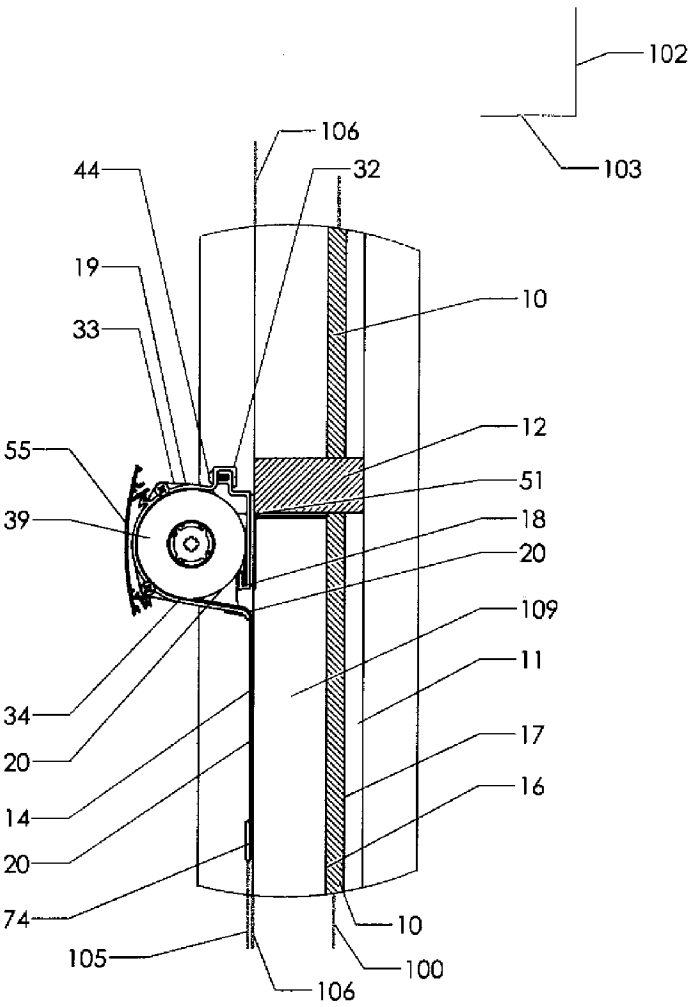
FIG. 19 is a reduced first end elevational view of the assembled third alternative window shade system or assembly according to the present invention with the first end cap unit removed from the system to show otherwise hidden inner components of the system as adhesively mounted to a header element of a fragmentary window site shown in cross-section.
Figure 18:
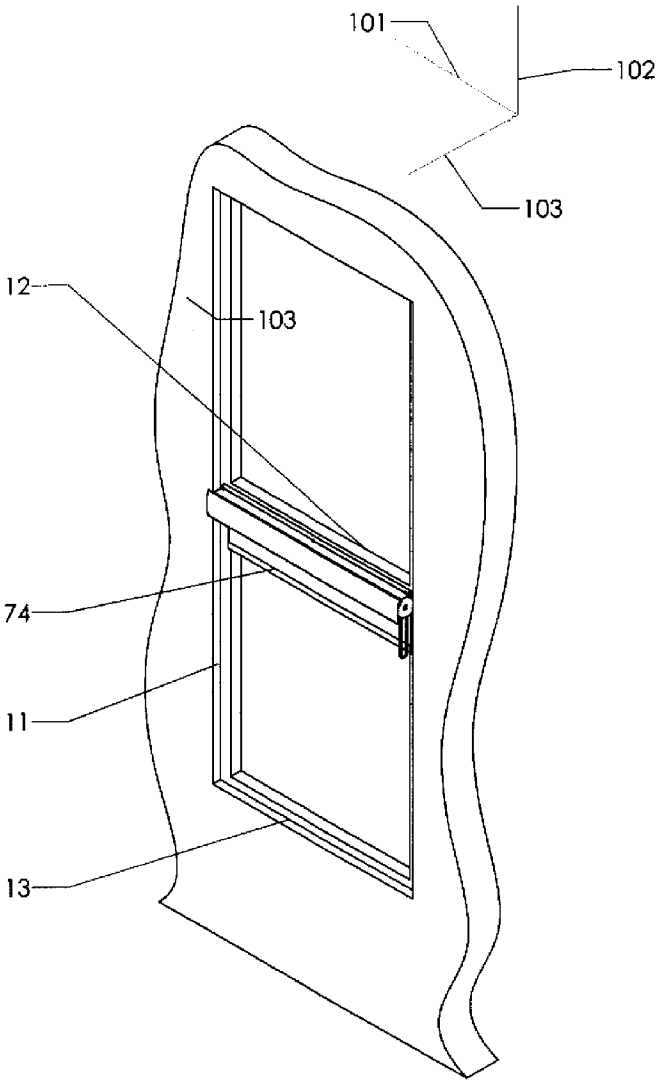
FIG. 18 is a reduced top first end perspective view of the third alternative window shade system or assembly according to the present invention as mounted at an exemplary window site of a fragmentary building construction.
Figure 20:
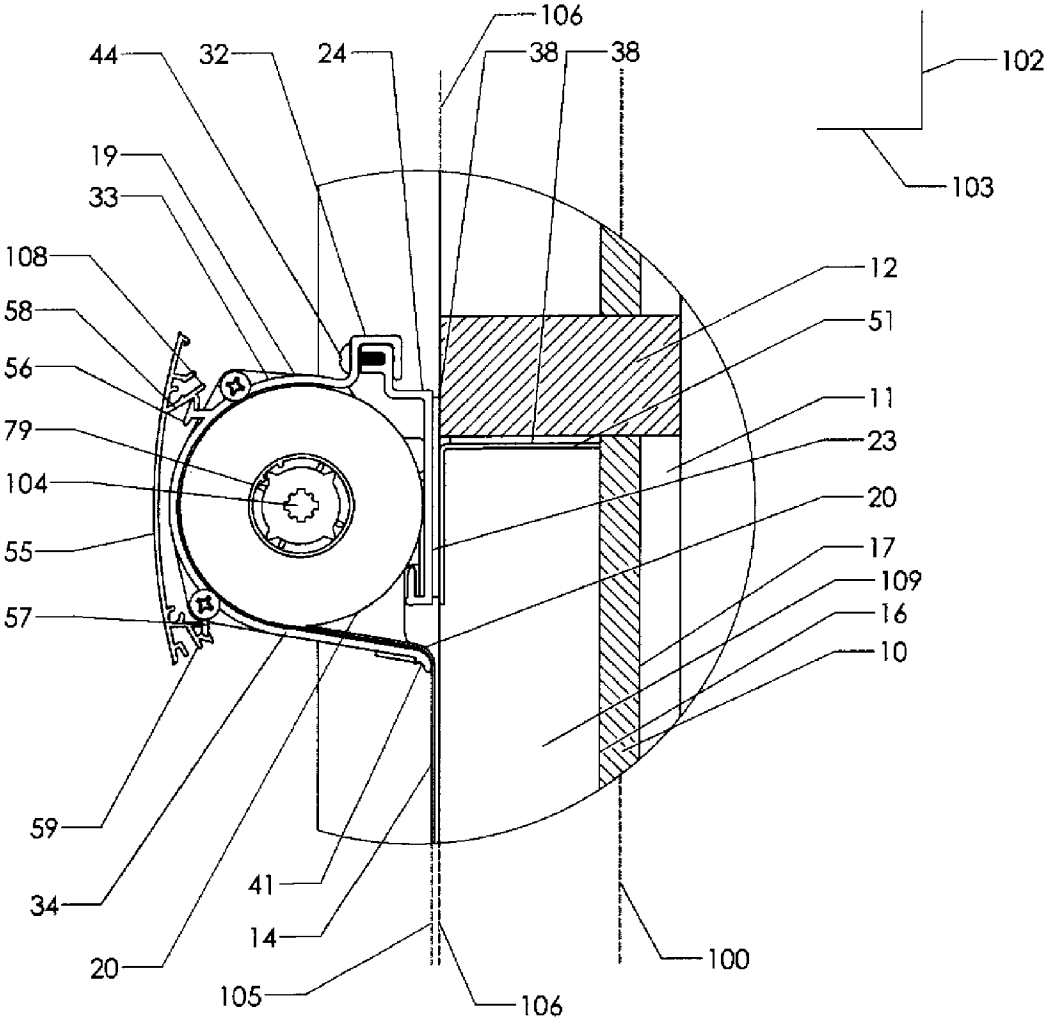
FIG. 20 is an enlarged first end view of a fragmentary assembled third alternative window shade system or assembly according to the present invention with the first end cap unit removed from the system to show otherwise hidden inner components of the system as mounted to a header element of a fragmentary window site shown in cross-section.
Figure 21:
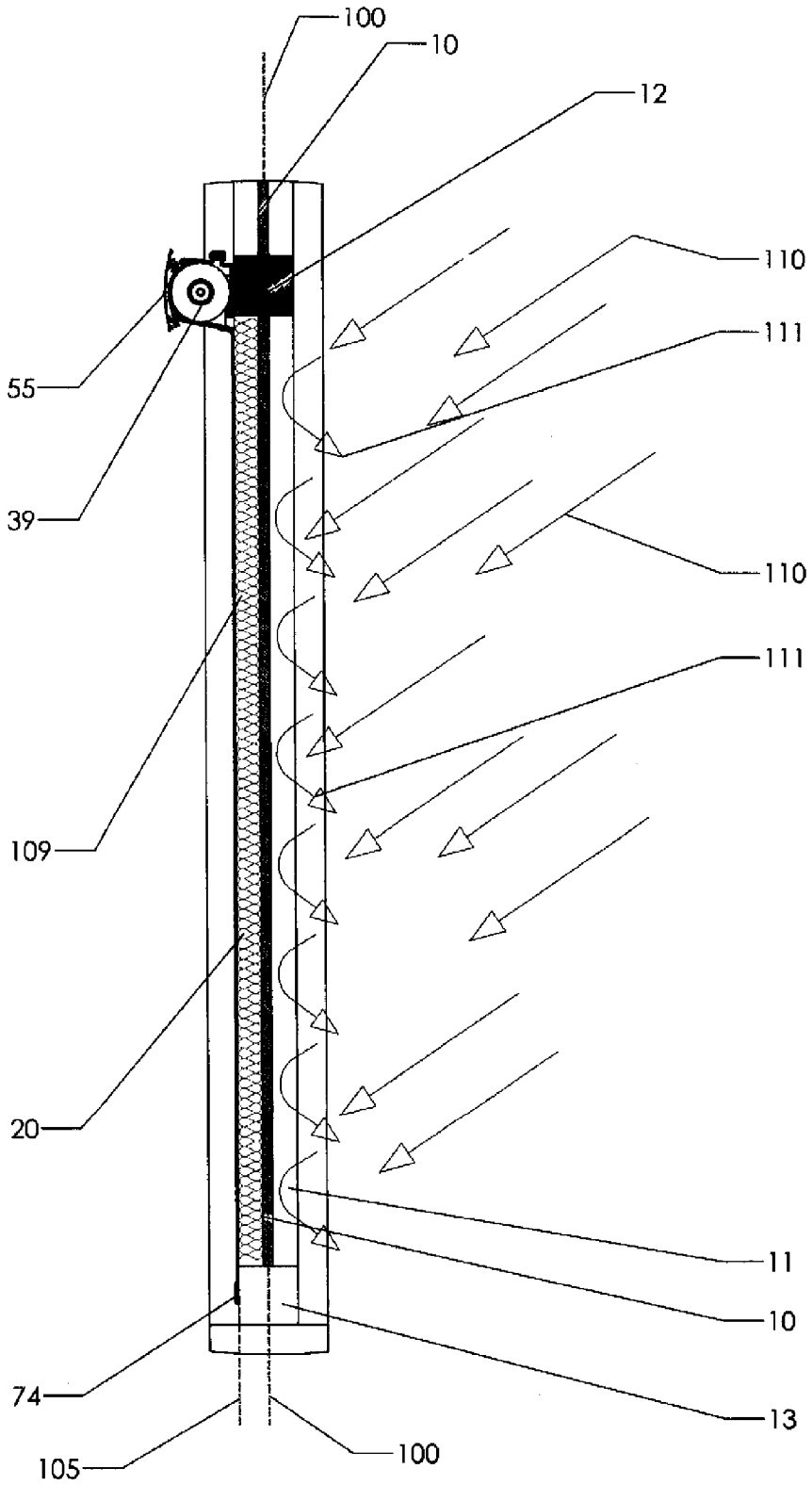
FIG. 21 is a diagrammatic depiction of the preferred window shade system or assembly according to the present invention with the first end cap unit removed from the system to show otherwise hidden inner components of the system as mounted to a header element of a fragmentary window site shown in cross-section to diagrammatically demonstrate an insulative air layer and external thermal loads being shade-blocked by the shade element of the window shade system or assembly.
Figure 21A:
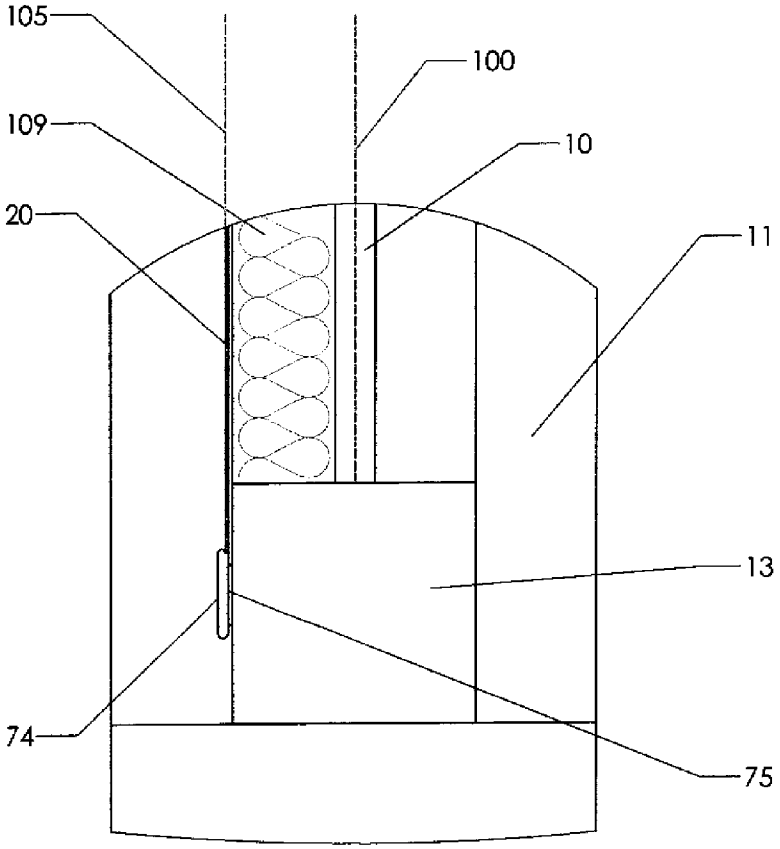
FIG. 21(A) is an enlarged fragmentary sectional view of the lower end portions of the subject matter otherwise depicted in FIG. 21 to show in greater detail structures associated with the lower end portions of the window shade system or assembly according to the present invention.

FIGS. 1-3, 9-11, 15-17, and 22(A) attempt to generally depict user-powerable or user-powered means for furling and unfurling the shade element 20, and FIG. 8 attempts to generally depict certain electrically-powerable means for furling and unfurling the shade element 20. From a comparative inspection of FIGS. 1-3, 9-11, 15-17, and 22(A) versus FIG. 8, it will be seen that FIGS. 1-3, 9-11, 15-17, and 22(A) depict a chain, cord or cord-like element 69 graspable by a user's hand and cooperable with a rotatable first end-based axis-fixing unit 70 attachable to a first (cord-) end cap unit 71 for selectively furling and unfurling the shade element 20 via forced directed into the cord element 69 via a user's hand. Opposite the cord-end cap unit 71 is a second end cap unit 72 cooperable with a rotatable second end-based axis-fixing unit 73.

The cap units 71 and 72 attach to the rotatable end-based axis-fixing units 70 and 73, and the rotatable end-based axis-fixing units 70 and 73 are attachable to a tubular core element 79, which tubular core element 79 is insertable through tunnel portion 80 of the furled portion 39 of the shade element 20 and attachable to the furled portion 39 of the shade element 20. End cap units 71 and 72 enable the interface bracket element 18 to be installed at the time of original measuring of the window opening. The end cap units 71 and 72 allow the shade housing to adjust laterally onto the pre-mounted F plate or interface bracket element 18. Together, the cap units 71, 72, end-based axis-fixing units 70, 73; and core element 79 exemplify the preferred axis-fixing means for fixing the shade axis of rotation 104 according to the present invention.

Figure 1:
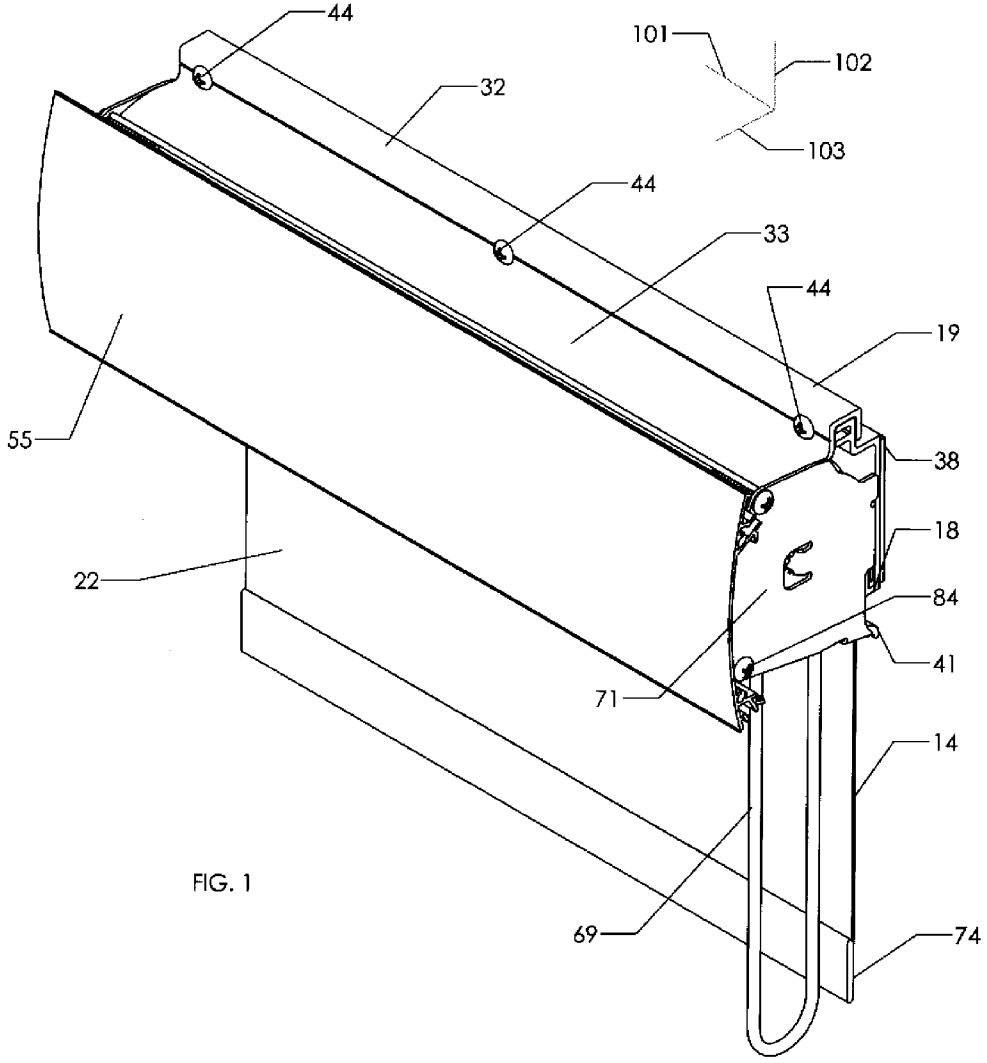
FIG. 1 is a top first end perspective view of a fully assembled preferred window shade system or assembly according to the present invention with a first end cap unit assembled to the system or assembly.
Figure 1A:
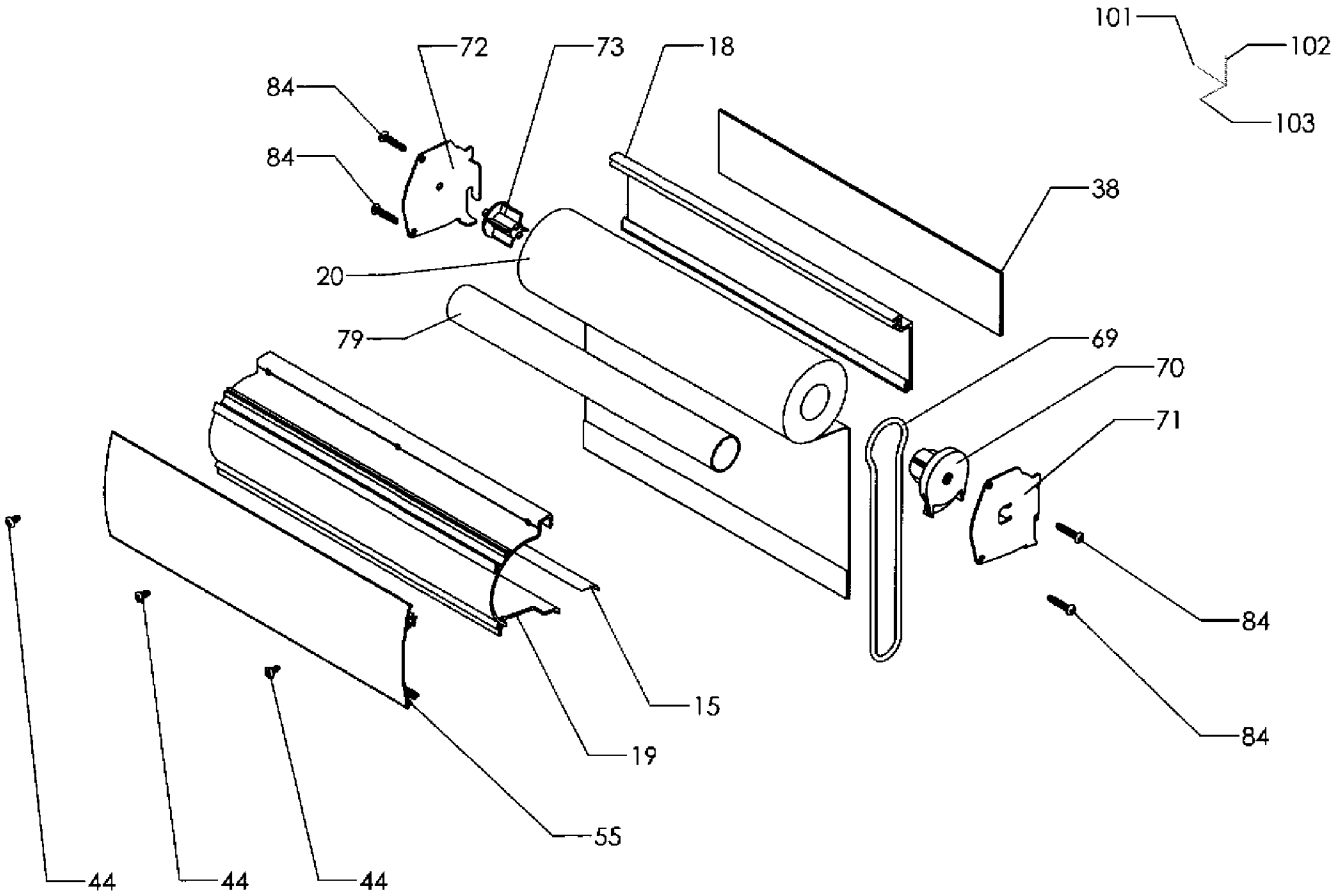
FIG. 1(A) is an exploded top first end perspective view of the preferred window shade system or assembly according to the present invention otherwise depicted in FIG. 1.
Figure 2:
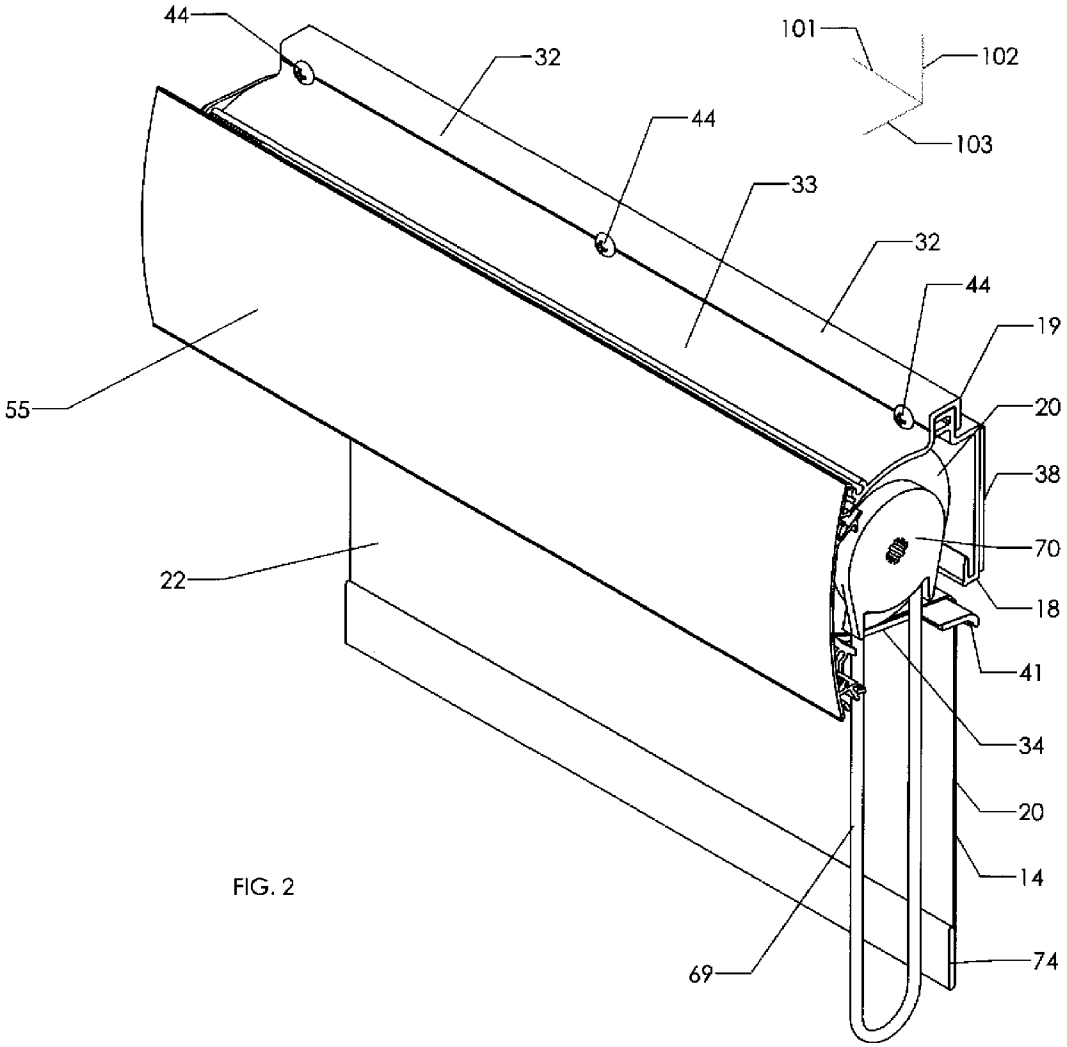
FIG. 2 is a top first end perspective view of an assembled preferred window shade system or assembly according to the present invention with a first end cap unit removed from the system to show otherwise hidden inner components of the system or assembly.
Figure 3:
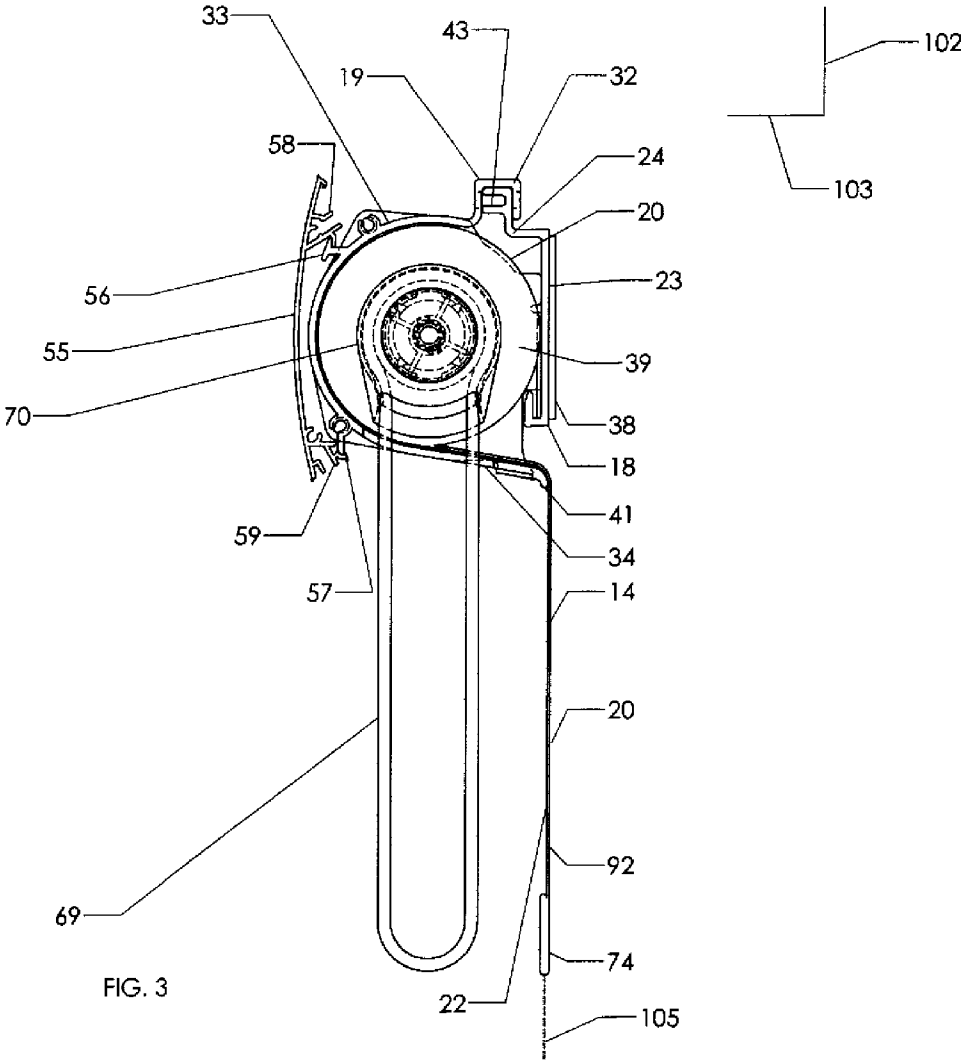
FIG. 3 is a first end elevational view of the assembled preferred window shade system or assembly according to the present invention with the first end cap unit removed from the system to show otherwise hidden inner components of the system or assembly.
Figure 5:
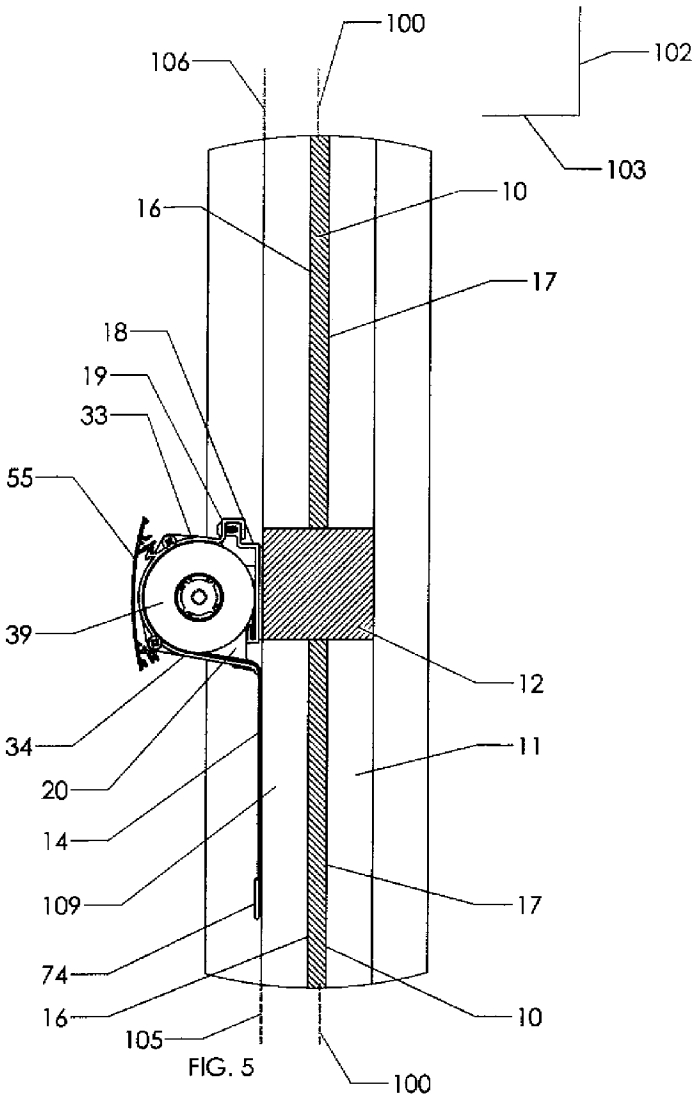
FIG. 5 is a reduced first end elevational view of the assembled preferred window shade system or assembly according to the present invention with the first end cap unit removed from the system to show otherwise hidden inner components of the system as adhesively mounted to a header element of a fragmentary window site shown in cross-section.
Figure 4:
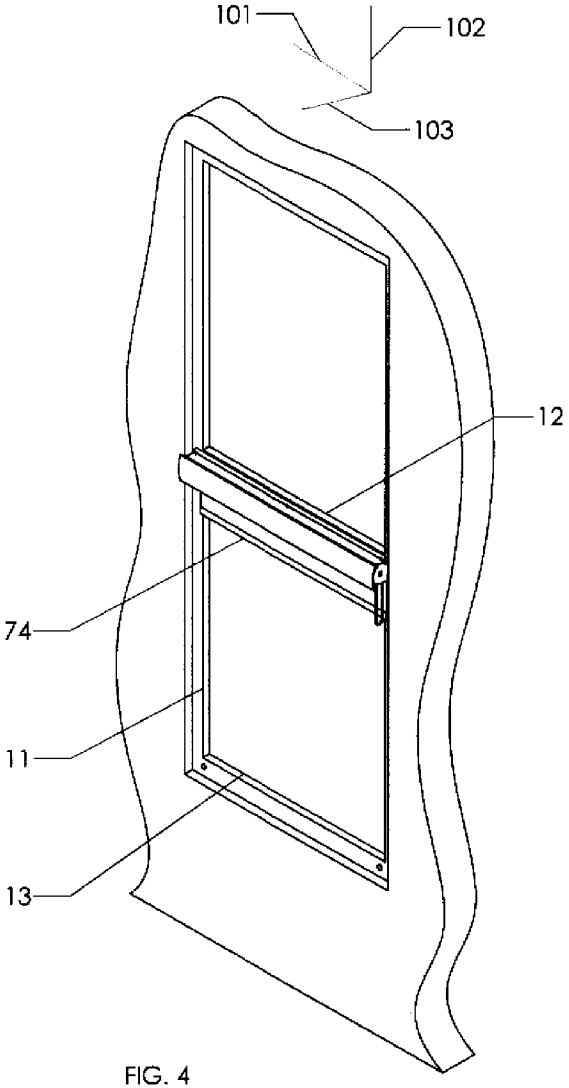
FIG. 4 is a reduced top first end perspective view of the preferred window shade system or assembly according to the present invention as adhesively mounted at an exemplary window site of a fragmentary building construction.
Figure 6:
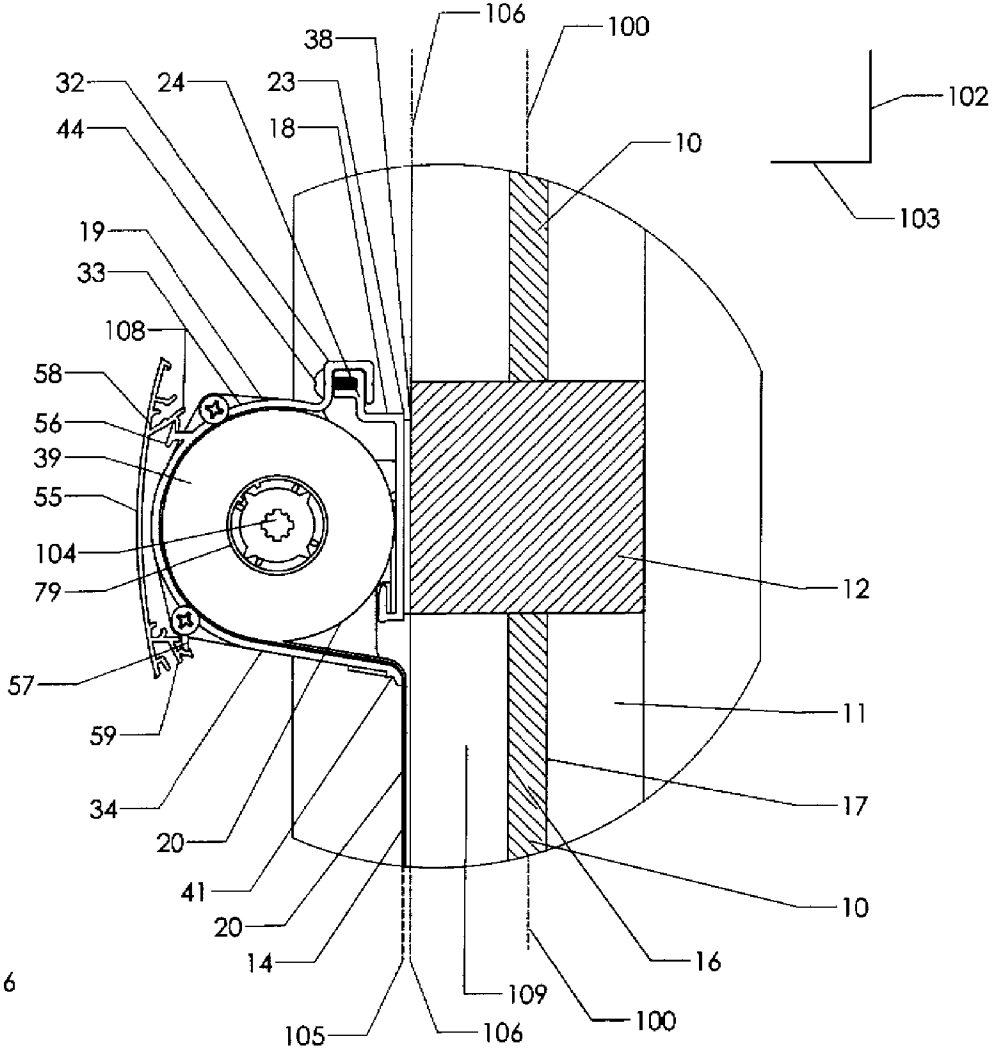
FIG. 6 is an enlarged first end view of a fragmentary assembled preferred window shade system or assembly according to the present invention with the first end cap unit removed from the system to show otherwise hidden inner components of the system as adhesively mounted to a header element of a fragmentary window site shown in cross-section.
Figure 7:
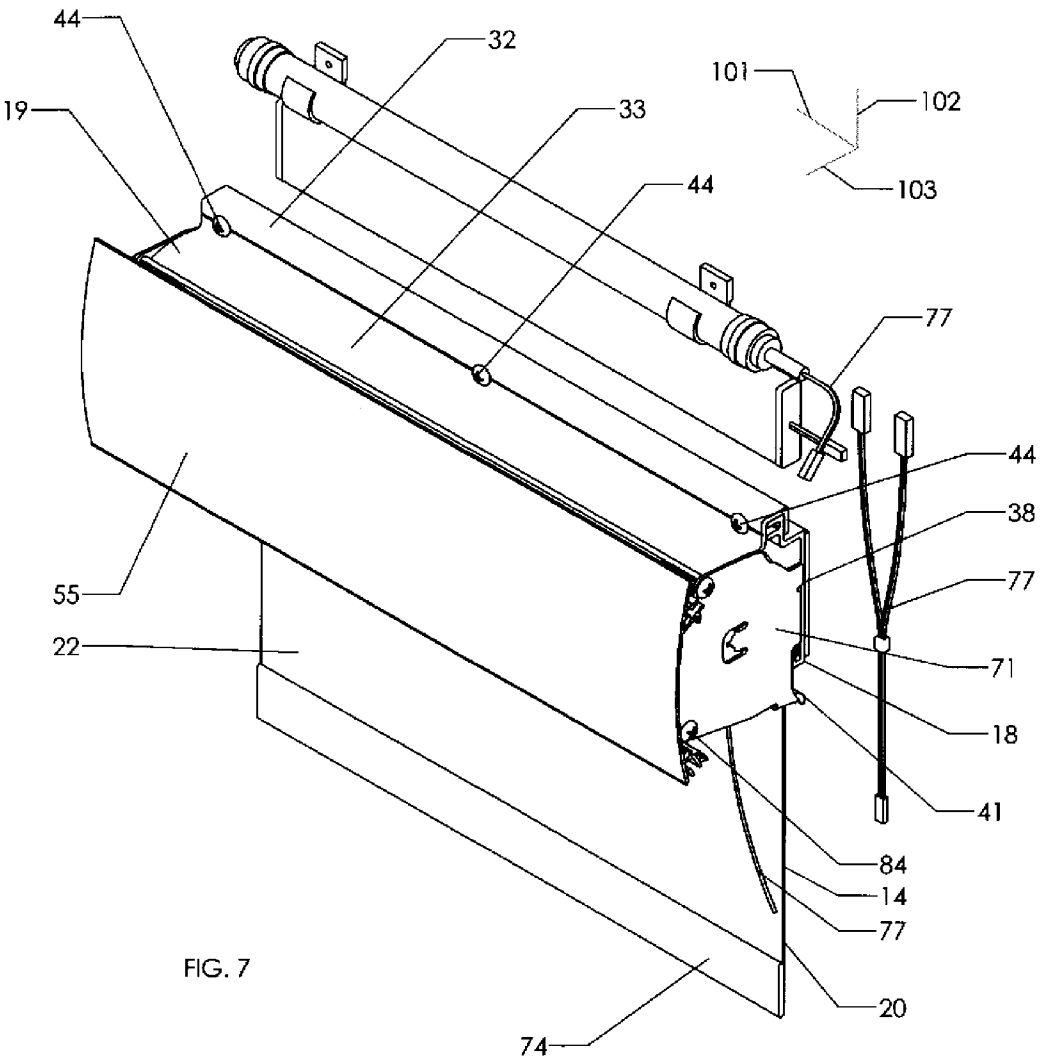
FIG. 7 is a top first end perspective view of an assembled first alternative window shade system or assembly according to the present invention with a first end cap unit assembled to the system or assembly.

Alternatively, FIGS. 7 and 8 attempt to draw attention to a motor-driven shade assembly, which motor-driven shade assembly comprises a rotatable motor-driven core element 76 and circuitry 77 for delivering power to the core element 76 for selectively rotating the same in a shade-furling direction or a shade-unfurling direction. Together, the cap units 71, 72, end-based axis-fixing units 70, 73; and core element 76 exemplify certain alternative axis-fixing means for fixing the shade axis of rotation 104 according to the first embodiment.

While the foregoing specifications set forth much specificity, the same should not be construed as setting forth limits to the invention but rather as setting forth certain preferred embodiments and features. For example, as prefaced hereinabove, it is contemplated that the present invention essentially provides a window shade system for shading a window, the window shade system comprising, in combination: a shade assembly, a bracket element as at 18 or 18', and a guide-cover element as at 19. The bracket element and the guide-cover element together may be said to define a housing-guide assembly as at 90 (elements 18 and 19) or 90' (elements 18' and 19) according to the present invention.

The shade assembly may be said to essentially comprise a shade element 20 having furled portions as at 39 and unfurled or unfurlable portions as at 14. The shade assembly may be said to further preferably comprise certain axis fixing means as hereinabove exemplified for fixing a shade axis of rotation as at 104. The shade element 20 is thus furlable and unfurlable about the shade axis for rotation 104 for selectively shading a window or similar other construction when the system or assembly is mounted in adjacency thereto.

The bracket element as at 18 or 18' preferably comprises a bracket-to-support interface portion as at 23 and a guide-cover attachment portion as at 24. The guide-cover attachment portion preferably comprises a spacer portion as at 29 and at least an inverted L-shaped portion and preferably an F-shaped portion with an added flange or secondary support portion 42 parallel to the primary support portion 31 extending from the riser portion 30.

The guide-cover element 19 essentially comprises an inverted Π-shaped, channel portion 32, a shade-cover portion 33, and a shade-guide portion 34. The channel portion 32 thus has a posterior extension portion 35, an anterior extension portion 36, and a spacer extension portion 37. The shade-cover portion is preferably formed so as to subtend an arc length radially anterior relative to the posterior extension portion 35. The shade-guide portion 34 is preferably formed so as to extend in a plane 114 obliquely angled (as at angle 113) relative to a horizontal plane as at 112.

The interface portion is preferably (adhesively) attachable to a (vertical) support structure. The shade element 20 being receivable in space 40 defined by the shade-cover portion 33, and the axis fixing means fix the shade axis of rotation 104 relative to the shade-cover portion 33. The guide-cover element 19 and shade assembly are attachable to the bracket element 18 or 18' such that the guide-cover attachment portion 24 is received in the channel portion 32. The shade-guide portion 34 is preferably downwardly sloped for slope-guiding the shade element 20 when unfurled.

The shade-guide portion 34 terminates posteriorly at a guide-cover terminus 41 located in inferior adjacency to the interface portion 23. The shade element 20 is unfurlable via a shade-letting gap 91 defined intermediate the shade-guide portion 34 and the interface portion 23. The unfurled portion 14 of the shade element 20 is extendable in a shade plane 105 via the guide-cover terminus 41 for selectively shading the window 10.

The guide-cover attachment portion 24 preferably comprises a flange or secondary support portion 42 parallel to the primary support portion 31. Together, the primary and secondary support portions 31 and 42 simultaneously contacting the anterior extension portion 36 for preventing rotation of the guide-cover element 19 relative to the bracket element 18 or 18'. The primary and secondary support portions 31 and 42 are spaced via the riser portion 30 so as to effect a fastener-receiving channel as at 43, which fastener receiving channel f43 receives least one fastener 44. The at least one fastener 44 fastens the guide-cover element 19 to the bracket element 18 or 18'.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures, and the appended claims and drawings.

We claim:

1. A window shade system for shading a window, the window shade system comprising, in combination:

a shade assembly, the shade assembly comprising a shade element and axis fixing means for fixing a shade axis of rotation, the shade element being furlable and unfurlable about the shade axis for rotation for selectively shading the window;

the shade element oriented about the shade axis of rotation such that the shade element hangs from the shade axis of rotation opposite the window;

a bracket element, the bracket element comprising a bracket-to-support interface portion and a guide-cover attachment portion, the guide-cover attachment portion comprising an inverted L-shaped portion and a spacer portion, the L-shaped portion having a primary riser portion and a primary support portion; and a guide-cover element, the guide-cover element comprising a Π-shaped, channel portion, a shade-cover portion, and a shade-guide portion, the channel portion having a posterior extension portion, an anterior extension portion and a spacer extension portion, and the channel portion being elevated with respect to the shade-cover portion, the shade-cover portion being formed so as to subtend an arc length radially anterior relative to the posterior extension portion, the shade-guide portion being formed so as to extend obliquely relative to a horizontal plane, the bracket-to-support interface portion being attachable to a support structure, the shade element being received in a space defined by the shade-cover portion, the axis fixing means fixing the shade axis of rotation relative to the shade-cover portion, the guide-cover element and shade assembly being attachable to the bracket element such that the guide-cover attachment portion is received in the channel portion, the shade-guide portion being downwardly sloped for guiding the shade element when being unfurled, the shade-guide portion terminating posteriorly at a guide-cover terminus situated in inferior adjacency to the bracket-to-support interface portion, an unfurled portion of the shade element being extendable through a shade-letting gap defined by the bracket-to-support interface portion and the guide-cover terminus and downwardly via the guide-cover terminus for selectively shading the window.

2. The window shade system of claim 1 wherein the guide-cover attachment portion comprises a secondary support portion parallel to the primary support portion, the primary and secondary support portions extending in the same direction for simultaneously contacting the anterior extension portion for preventing rotation of the guide-cover element relative to the bracket element.

3. The window shade system of claim 2 wherein the primary and secondary support portions are spaced via the riser portion so as to effect a fastener-receiving channel, the fastener receiving channel for receiving at least one fastener, the at least one fastener for fastening the guide-cover element to the bracket element.

4. The window shade system of claim 1 wherein the shade-guide portion is outfitted with friction reduction means for reducing friction between the shade element and the shade-guide portion and enhancing uniform unfurlment of the shade element.

5. The window shade system of claim 1 wherein the bracket element comprises an L-shaped upper support attachment portion, the upper support attachment portion comprising an upper support riser portion and a load bearing upper support flange portion, the upper support flange portion being spaced from the primary support portion for enabling the guide-cover attachment portion to be received in the channel portion, the upper support flange portion providing means for attaching the bracket element to an upper support structure.

6. The window shade system of claim 1 comprising, in combination in combination, a mount element, the mount element comprising a first mount portion a second mount portion orthogonal to the first mount portion, the first mount portion being attachable to the bracket-to-support interface portion, the second mount portion being attachable to an upper support structure, and capable of supporting the shade system without a mechanical screw.

7. The window shade system of claim 1 comprising a valance, the valance being cooperable with a set of guide elements set onto the exterior of the guide-cover element, the valance being capable of snapping onto and off of the guide elements and capable of sliding horizontally thereon, for concealing the guide-cover element.

8. The window shade system of claim 1 comprising select means for furling and unfurling the shade element of the shade assembly, the select means being selected from the group consisting of user-powered means and electrically-powered means.

9. The window shade system of claim 1 wherein:

the shade-cover portion is formed of a single arc length radially anterior relative to the posterior extension portion.

10. The window shade system of claim 1 further comprising:

a first end cap unit connected to one side of the bracket element and the guide cover element;

a first end-based axis-fixing unit attachable to the first end cap unit for selectively furling and unfurling the shade element;

a second end cap unit opposite the first end cap unit; and a rotatable second end-based axis-fixing unit cooperable with the second end cap unit.

11. The window shade system of claim 10 wherein the first and second end cap unit selectively engage the guide-cover element to prevent rotation of the guide cover element during furling and unfurling of the shade element.

12. The window shade system of claim 8 wherein the select means for furling and unfurling the shade element of the shade assembly comprises:

a chain or cord cooperable with a rotatable first end of the shade axis of rotation.

13. A housing-guide assembly for housing a furled shade element and guiding the same as it unfurls, the housing-guide assembly comprising:

a bracket element, the bracket element comprising a bracket-to-support interface portion and a guide-cover attachment portion, the guide-cover attachment portion comprising an inverted L-shaped portion and a spacer portion, the L-shaped portion having a primary riser portion and a primary support portion; and a guide-cover element, the guide-cover element comprising a channel portion, a shade-cover portion, and a shade-guide portion, the channel portion having a posterior extension portion, an anterior extension portion and a spacer extension portion, the channel portion being elevated with respect to the shade cover portion, the shade-cover portion being formed so as to subtend a single arc length radially anterior relative to the posterior extension portion, the bracket-to-support interface portion being attachable via an adhesive element attached to the bracket-to-support interface potion to a support structure, the guide-cover element being attachable to the bracket element such that the guide-cover attachment portion is received in the channel portion, a furled shade element being receivable in a space defined by the shade-cover portion and unfurlable via a shade-letting gap defined intermediate the shade-guide portion and the bracket-to-support interface portion the furled shade element oriented such that the furled shaded element unfurls within the shaded-cover portion on a side of the furled shade element opposite a vertical surface; and the adhesive element capable of adhering the housing-guide assembly to the support structure.

14. The housing-guide assembly of claim 13 wherein the shade-guide portion is downwardly sloped for guiding the shade element when being unfurled via the shade-letting gap.

15. The housing-guide assembly of claim 13 wherein the shade-guide portion terminates posteriorly at a guide-cover terminus, the guide-cover terminus being spatially situated in inferior adjacency to the bracket-to-support interface portion.

16. The housing-guide assembly of claim 13 wherein the guide-cover attachment portion comprises a secondary support portion parallel to the primary support portion, the primary and secondary support portions extending in the same direction for simultaneously contacting the anterior extension portion for preventing rotation of the guide-cover element relative to the bracket element.

17. The housing-guide assembly of claim 16 wherein the primary and secondary support portions are spaced via the riser portion so as to effect a fastener-receiving channel, the fastener receiving channel for receiving at least one fastener, the at least one fastener for fastening the guide-cover element to the bracket element.

18. The housing-guide assembly of claim 13 wherein the adhesive element is a double sided adhesive material capable of mating an anodized aluminum surface to a vertical anodized aluminum support surface, capable of supporting the entire weight of the housing guide assembly, and capable of being removed without damaging the vertical anodized aluminum support surface.

19. The housing-guide assembly of claim 13 wherein the bracket element comprises an L-shaped upper support attachment portion, the upper support attachment portion comprising an upper support riser portion and a load bearing upper support flange portion, the upper support flange portion being spaced from the primary support portion for enabling the guide-cover attachment portion to be received in the channel portion, the upper support flange portion providing means for attaching the bracket element to an upper support structure.

20. The window shade system of claim 13 comprising, in combination, a mount element, the mount element comprising a first mount portion a second mount portion orthogonal to the first mount portion, the first mount portion being attachable to the bracket-to-support interface portion, the second mount portion being attachable to an upper support structure, and capable of supporting the shade system without a mechanical screw.

* * * * *